US009045995B2

(12) United States Patent
Graybill et al.

(10) Patent No.: US 9,045,995 B2
(45) Date of Patent: Jun. 2, 2015

(54) ELECTRONICS RACK WITH LIQUID-COOLANT-DRIVEN, ELECTRICITY-GENERATING SYSTEM

(75) Inventors: David P. Graybill, Staatsburg, NY (US); Allan R. Hoeft, Poughkeepsie, NY (US); Madhusudan K. Iyengar, Woodstock, NY (US); Donald W. Porter, Highland, NY (US); Enrico A. Romano, Poughkeepsie, NY (US); Roger R. Schmidt, Poughkeepsie, NY (US); Gerard V. Weber, Jr., Saugerties, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 393 days.

(21) Appl. No.: 13/103,233

(22) Filed: May 9, 2011

(65) Prior Publication Data

US 2012/0286514 A1 Nov. 15, 2012

(51) Int. Cl.

| | |
|---|---|
| ***F01D 15/10*** | (2006.01) |
| ***F02C 6/00*** | (2006.01) |
| ***H02K 7/18*** | (2006.01) |
| ***H02P 9/04*** | (2006.01) |
| ***F02B 63/04*** | (2006.01) |
| ***F03G 7/08*** | (2006.01) |
| ***F03B 13/00*** | (2006.01) |
| ***F03B 13/10*** | (2006.01) |
| *F01D 15/08* | (2006.01) |

(52) U.S. Cl.

CPC ..... *F01D 15/10* (2013.01); *F01D 15/08* (2013.01)

(58) Field of Classification Search

CPC ..... F03B 17/00; F03B 3/12; F03B 3/128; F03B 11/002; Y02E 10/20

USPC ..... 290/1 R, 43; 310/156.11

See application file for complete search history.

(56) References Cited

U.S. PATENT DOCUMENTS

| | | | | |
|---|---|---|---|---|
| 4,272,686 | A | 6/1981 | Suzuki | |
| 4,587,450 | A * | 5/1986 | Ozaki | 310/156.11 |
| 4,588,914 | A * | 5/1986 | Heyne | 310/156.11 |
| 4,942,322 | A * | 7/1990 | Raybould et al. | 310/156.11 |
| 6,011,334 | A * | 1/2000 | Roland | 310/86 |
| 6,601,390 | B1 * | 8/2003 | Yazawa et al. | 60/650 |

(Continued)

OTHER PUBLICATIONS

"Dymotec Sidewall Dynamos and Lights," http://peterwhitecycles.com/dymotec.asp, Mar. 2011.

(Continued)

*Primary Examiner* — Tulsidas C Patel
*Assistant Examiner* — Charles Reid, Jr.
(74) *Attorney, Agent, or Firm* — Margaret A. McNamara, Esq.; Kevin P. Radigan, Esq.; Heslin Rothenberg Farley & Mesiti P.C.

(57) ABSTRACT

An electronics rack with a cooling apparatus and a liquid-coolant-driven, electricity-generating system. The generating system includes a housing coupled in fluid communication with a fluid transport pipe of the cooling apparatus, an impeller disposed within the housing and positioned to turn with flow of fluid across the impeller, one or more magnetic structures disposed to turn with turning of the impeller, and an electrical circuit. Electricity is generated for the electrical circuit with turning of the one or more magnetic structures, and is supplied to an electrical load disposed within or associated with the electronics rack.

17 Claims, 18 Drawing Sheets

(56) References Cited

U.S. PATENT DOCUMENTS

| | | | | |
|---|---|---|---|---|
| 6,672,054 | B2 | 1/2004 | Merswolke et al. | |
| 6,775,137 | B2 | 8/2004 | Chu et al. | |
| 6,819,563 | B1 | 11/2004 | Chu et al. | |
| 6,856,037 | B2 * | 2/2005 | Yazawa et al. | 290/43 |
| 7,081,684 | B2 * | 7/2006 | Patel et al. | 290/1 R |
| 7,084,521 | B1 | 8/2006 | Martin | |
| 7,274,566 | B2 * | 9/2007 | Campbell et al. | 361/699 |
| 7,385,810 | B2 | 6/2008 | Chu et al. | |
| 7,481,283 | B2 * | 1/2009 | McDonald et al. | 175/106 |
| 7,584,610 | B2 | 9/2009 | Ziegenfuss | |
| 7,638,914 | B2 * | 12/2009 | Miekka | 310/154.01 |
| 7,663,258 | B2 | 2/2010 | Baarman et al. | |
| 7,757,506 | B2 | 7/2010 | Ellsworth, Jr. et al. | |
| 7,942,646 | B2 * | 5/2011 | Zhou et al. | 417/366 |
| 2007/0024140 | A1 * | 2/2007 | Oximberg et al. | 310/156.11 |
| 2007/0151969 | A1 * | 7/2007 | Tain et al. | 219/631 |
| 2007/0228847 | A1 * | 10/2007 | Kim | 310/61 |
| 2007/0269323 | A1 * | 11/2007 | Zhou et al. | 417/423.7 |
| 2008/0158815 | A1 * | 7/2008 | Campbell et al. | 361/696 |
| 2008/0238105 | A1 | 10/2008 | Ortiz et al. | |
| 2009/0110563 | A1 | 4/2009 | Takita et al. | |
| 2009/0152367 | A1 * | 6/2009 | Fraccaro | 237/12.1 |
| 2009/0179426 | A1 * | 7/2009 | Alvarez et al. | 290/54 |
| 2009/0278355 | A1 | 11/2009 | Baarman et al. | |
| 2011/0051372 | A1 | 3/2011 | Barringer et al. | |
| 2011/0203976 | A1 * | 8/2011 | Baker | 209/214 |

OTHER PUBLICATIONS

Saket, Dr. R.K., "Design, Development and Reliability Evaluation of Micro Hydro Power Generation System Based on Municipal Waste Water," 2008 IEEE Electrical Power & Energy Conference, Oct. 2008.

Graybill, David P. et al., "Airflow Recirculation and Cooling Apparatus and Method for an Electronics Rack," U.S. Appl. No. 12/708,792, filed Feb. 19, 2010.

* cited by examiner

ELECTRONICS RACK WITH LIQUID-COOLANT-DRIVEN, ELECTRICITY-GENERATING SYSTEM

BACKGROUND

In many large server applications, processors along with their associated electronics (e.g., memory, disk drives, power supplies, etc.) are packaged in removable drawer configurations stacked within a rack or frame. In other cases, the electronics may be in fixed locations within the rack or frame. Conventionally, the components are cooled by air moving in parallel airflow paths, usually front-to-back impelled by one or more air moving devices (e.g., fans or blowers). In some cases, it may be possible to handle increased power dissipation within a single drawer by providing greater airflow, through the use of a more powerful air moving device or by increasing the rotational speed (i.e., RPMs) of an existing air moving device. However, this approach is becoming problematic at the rack level in the context of a computer installation (e.g., data center).

The sensible heat load carried by the air exiting the rack is stressing the availability of the room air-conditioning to effectively handle the load. This is especially true for large installations with "server farms" or large banks of computer racks close together. In such installations, liquid cooling (e.g., water cooling) is an attractive technology to manage the higher heat fluxes. The liquid absorbs the heat dissipated by the components/modules in an efficient manner. Typically, the heat is ultimately transferred from the liquid to an outside environment, whether air or liquid cooled.

Additionally, in today's data center, wireless, battery powered electrical components are becoming more widely accepted and more frequently deployed. Batteries have a finite useable lifespan, and must be replaced often. Because of this, batteries do not insure constant and reliable performance of the powered electrical equipment and devices. Furthermore, the cost of replacement and special handling of disposed batteries are undesirable attributes to the use of batteries. Further, in certain sense and control circuitry implementations within a data center, standard power provided by a line chord may not be a preferred design approach due to cost, UL and other factors.

BRIEF SUMMARY

In one aspect, the shortcomings of the prior art are overcome and additional advantages are provided through the provision of a fluid-driven, electricity-generating system comprising: a housing; an impeller; at least one magnetic structure; and an electrical circuit. The housing is coupled in fluid communication with a fluid transport pipe of a data center and includes a first end and a second end. The first end receives fluid flowing through the fluid transport pipe and the second end returns the fluid to the fluid transport pipe. The impeller is disposed within the housing, and is configured and positioned to turn with the flow of fluid across the impeller. In addition, the at least one magnetic structure is disposed to turn with turning of the impeller. Electricity is generated within or for the electrical circuit with turning of the at least one magnetic structure, and the electrical circuit facilitates supplying the electricity to an electrical load, for example, disposed within or associated with the data center.

In another aspect, a data center is provided which includes: an electronics rack; a fluid transport pipe; and a fluid-driven, electricity-generating system. The fluid-drive, electricity-generating system includes: a housing; an impeller; at least one magnetic structure; and an electrical circuit. The housing is coupled in fluid communication with the fluid transport pipe and includes a first end and a second end. The first end receives fluid flowing through the fluid transport pipe and the second end returns the fluid to the fluid transport pipe. The impeller is disposed within the housing, and is configured and positioned to turn with the flow of fluid across the impeller. In addition, the at least one magnetic structure is disposed to turn with turning of the impeller. Electricity is generated within or for the electrical circuit with turning of the at least one magnetic structure, and the electrical circuit facilitates supplying the electricity to an electrical load associated with the electronics rack or associated with the data center.

In a further aspect, a method is provided which includes: providing a fluid-driven, electricity-generating system which includes: a housing comprising a first end and a second end; an impeller disposed within the housing, the impeller being configured and positioned to turn with the flow of fluid there across; at least one magnetic structure disposed to turn with turning of the impeller; and an electrical circuit associated with the housing, wherein electricity is generated for the electrical circuit with turning of the at least one magnetic structure; and coupling the housing in fluid communication with the fluid transport pipe of a data center, wherein fluid flowing through the fluid transport pipe is received through the first end of the housing and is returned through the second end of the housing, and the impeller turns with the flow of fluid through the housing; and electrically coupling the electrical circuit to an electrical load disposed within or associated with the data center.

Additional features and advantages are realized through the techniques of the present invention. Other embodiments and aspects of the invention are described in detail herein and are considered a part of the claimed invention.

BRIEF DESCRIPTION OF THE SEVERAL VIEWS OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1:
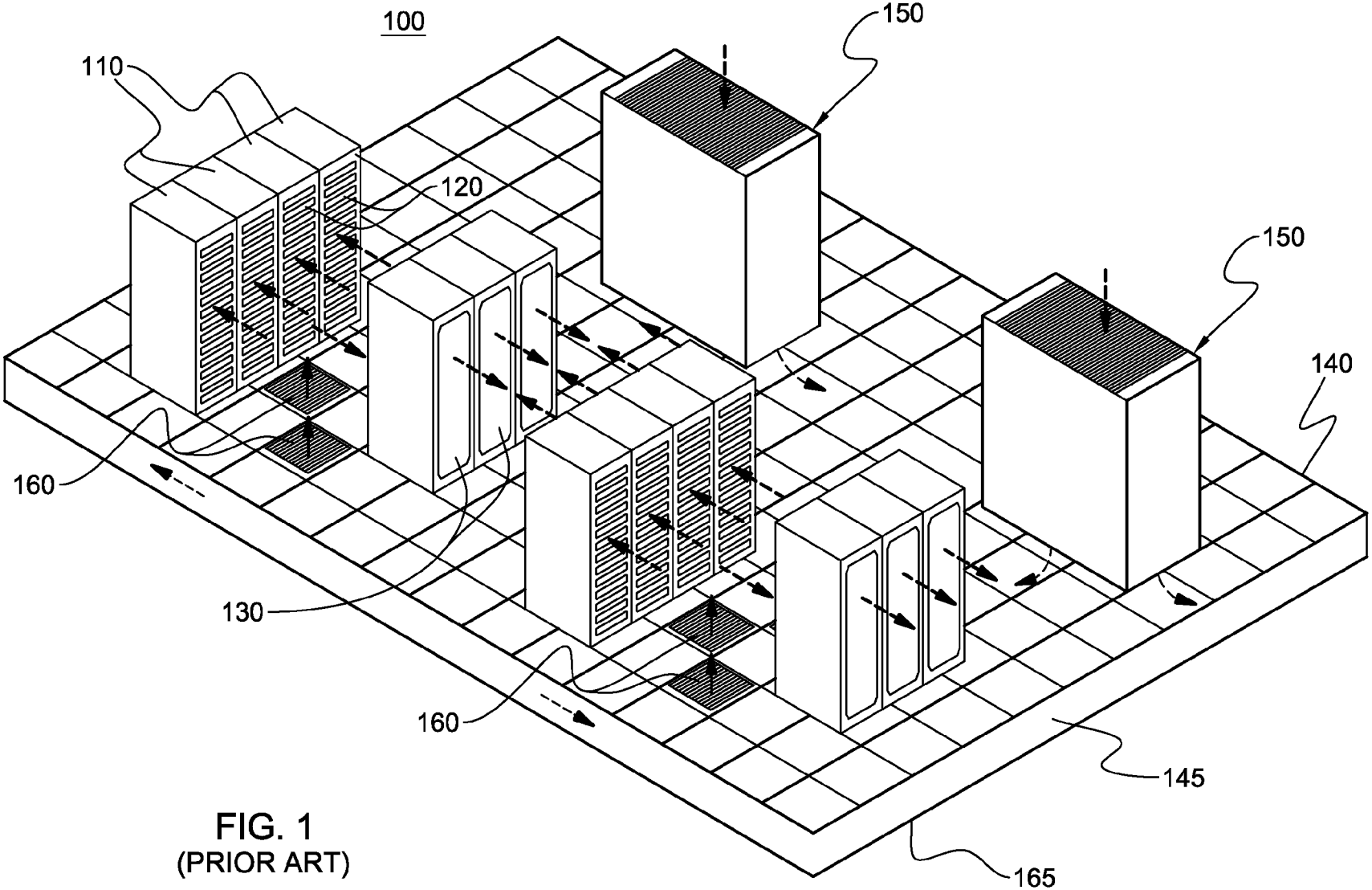
FIG. 1 (PRIOR ART)
FIG. 1 depicts one embodiment of a conventional raised floor layout of an air cooled data center.

Generally stated, disclosed herein are various embodiments of fluid-driven, electricity-generating systems and the use of such electricity-generating systems within a data center, for example, in association with facilitating cooling an electronics rack of the data center. By way of example, the fluid-driven, electricity-generating systems described herein may be employed in powering sense and control circuitry associated with controlling one or more actions related to cooling of one or more electronic components or systems of an electronics rack of the data center. Advantageously, a steady and reliable source of power for such circuitry is described herein for a data center having one or more fluid transport pipes, such as coolant transport pipes, which typically have well-defined specifications for pressure and flow of fluid. In the various examples described herein, the fluid may be liquid water, such as a facility water or water flowing through a secondary water loop of the data center, as explained below. However, the concepts disclosed herein are readily adapted to use with other types of fluid. For example, one or more of the fluids may comprise a brine, a fluorocarbon liquid, a liquid metal, or other similar coolant or refrigerant, while still maintaining the advantages and unique features of the present invention. Various data centers with liquid cooling of one or more aspects of an electronics rack are initially described below with reference to FIGS. 1-13, after which multiple fluid-driven, electricity-generating system embodiments for use in such data centers are described with reference to FIGS. 14-19.

As used herein, the terms "electronics rack", "rack-mounted electronic equipment", and "rack unit" are used interchangeably, and unless otherwise specified include any housing, frame, rack, compartment, blade server system, etc., having one or more heat generating components of a computer system or electronics system, and may be, for example, a stand alone computer processor having high, mid or low end processing capability. In one embodiment, an electronics rack may comprise multiple electronics subsystems, each having one or more heat generating components disposed therein requiring cooling. "Electronics subsystem" refers to any sub-housing, blade, book, drawer, node, compartment, etc., having one or more heat generating electronic components disposed therein. Each electronics subsystem of an electronics rack may be movable or fixed relative to the electronics rack, with rack-mounted electronics drawers of a multi-drawer rack unit and blades of a blade center system being two examples of subsystems of an electronics rack to be cooled.

"Electronic component" refers to any heat generating electronic component of, for example, a computer system or other electronics system, subsystem or unit requiring cooling. By way of example, an electronic component may comprise one or more integrated circuit dies and/or other electronic devices to be cooled, including one or more processor dies, memory dies and memory support dies. As a further example, the electronic component may comprise one or more bare dies or one or more packaged dies disposed on a common carrier.

As used herein, air-to-liquid heat exchanger to air-to-liquid heat exchange assembly means any heat exchange mechanism characterized as described herein through which liquid coolant can circulate; and includes, one or more discrete air-to-liquid heat exchangers coupled either in series or in parallel. An air-to-liquid heat exchanger may comprise, for example, one or more coolant flow paths, formed of thermally conductive tubing (such as copper or other tubing) in thermal or mechanical contact with a plurality of air-cooled cooling fins. Size, configuration and construction of the air-to-liquid heat exchange assembly and/or air-to-liquid heat exchanger thereof can vary without departing from the scope of the invention disclosed herein. Further, "data center" refers to a computer installation containing one or more electronics racks to be cooled. As a specific example, a data center may include one or more rows of rack-mounted computing units, such as server units.

Reference is made below to the drawings which are not drawn to scale for ease of understanding, wherein the same reference numbers used throughout different figures designate the same or similar components.

FIG. 1 depicts a raised floor layout of an air cooled data center 100 typical in the prior art, wherein multiple electronics racks 110 are disposed in one or more rows. A data center such as depicted in FIG. 1 may house several hundred, or even several thousand microprocessors. In the arrangement illustrated, chilled air enters the computer room via perforated floor tiles 160 from a supply air plenum 145 defined between the raised floor 140 and a base or sub-floor 165 of the room. Cooled air is taken in through louvered covers at air inlet sides 120 of the electronics racks and expelled through the back (i.e., air outlet sides 130) of the electronics racks. Each electronics rack 110 may have one or more air moving devices (e.g., fans or blowers) to provide forced inlet-to-outlet airflow to cool the electronic components within the drawer(s) of the rack. The supply air plenum 145 provides conditioned and cooled air to the air-inlet sides of the electronics racks via perforated floor tiles 160 disposed in a "cold" aisle of the computer installation. The conditioned and cooled air is supplied to plenum 145 by one or more air conditioning units 150, also disposed within the data center 100. Room air is taken into each air conditioning unit 150 near an upper portion thereof. This room air comprises in part exhausted air from the "hot" aisles of the computer installation defined by opposing air outlet sides 130 of the electronics racks 110.

Figure 2:
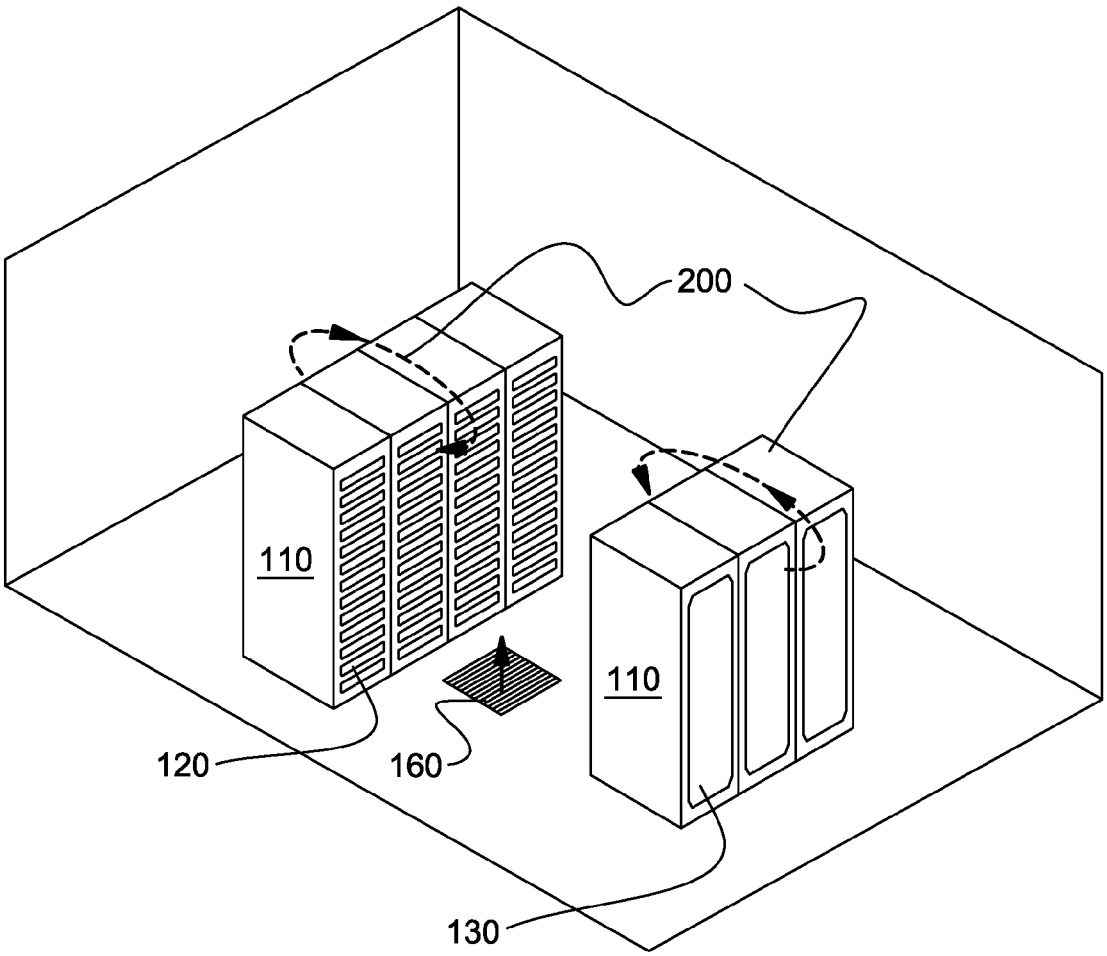
FIG. 2 (PRIOR ART)
FIG. 2 depicts one problem addressed by the heat exchangers disclosed herein, showing recirculation airflow patterns in one implementation of a raised floor layout of an air cooled data center.

Due to the ever increasing airflow requirements through electronics racks, and limits of air distribution within the typical data center installation, re-circulation problems within the room may occur. This is shown in FIG. 2 for a raised floor layout, wherein hot air re-circulation 200 occurs from the air outlet sides 130 of the electronics racks 110 back across the tops of the racks to the cold air aisle defined by the opposing air inlet sides 120 of the electronics rack. This re-circulation can occur because the conditioned air supplied through tiles 160 is typically only a fraction of the airflow rate forced through the electronics racks by the air moving devices disposed therein. This can be due, for example, to limitations on the tile sizes (or diffuser flow rates). The remaining fraction of the supply of inlet side air is often made up by ambient room air through re-circulation 200. This recirculating flow is often very complex in nature, and can lead to significantly higher rack unit inlet temperatures than desired.

The re-circulation of hot exhaust air from the hot aisle of the computer room installation to the cold aisle can be detrimental to the performance and reliability of the computer system(s) or electronic system(s) within the racks. Airflow distribution within a data center has a major impact on the thermal environment of the equipment located within the data center. A significant requirement of manufacturers is that the inlet temperature and humidity to the electronic equipment be maintained within specifications. For a class 1 datacom environment as specified by ASHRAE, the allowable inlet air temperature is in the range of 15-32° C., while the relative humidity is between 20-80%. Higher elevations require a de-rating of the maximum dry bulb temperature of 1° C. for every 300 m above an elevation of 900 m up to a maximum elevation of 3050 m. These temperatures/humidity requirements are to be maintained over the entire air inlet area of the rack. Three other class environments specified by ASHRAE generally have a wider range of environmental requirements.

For a raised floor layout such as depicted in FIG. 1, temperatures can range from 10-15° C. at the lower portion of the rack, close to the cooled air input floor vents, to as much as 35-40° C. at the upper portion of the electronics rack, where the hot air can form a self-sustaining re-circulation loop. Since the allowable rack heat load is limited by the rack inlet air temperature at the "hot" part, this temperature distribution correlates to an inefficient utilization of available chilled air. Also, computer installation equipment almost always represents a high capital investment to the customer. Thus, it is of significant importance, from a product reliability and performance view point, and from a customer satisfaction and business perspective, to limit the temperature of the inlet air to the rack unit to be substantially uniform. The efficient cooling of such computer and electronic systems, and the amelioration of localized hot air inlet temperatures to one or more rack units due to re-circulation of air currents, are addressed by the liquid cooling apparatuses and methods disclosed herein.

Figure 3A:
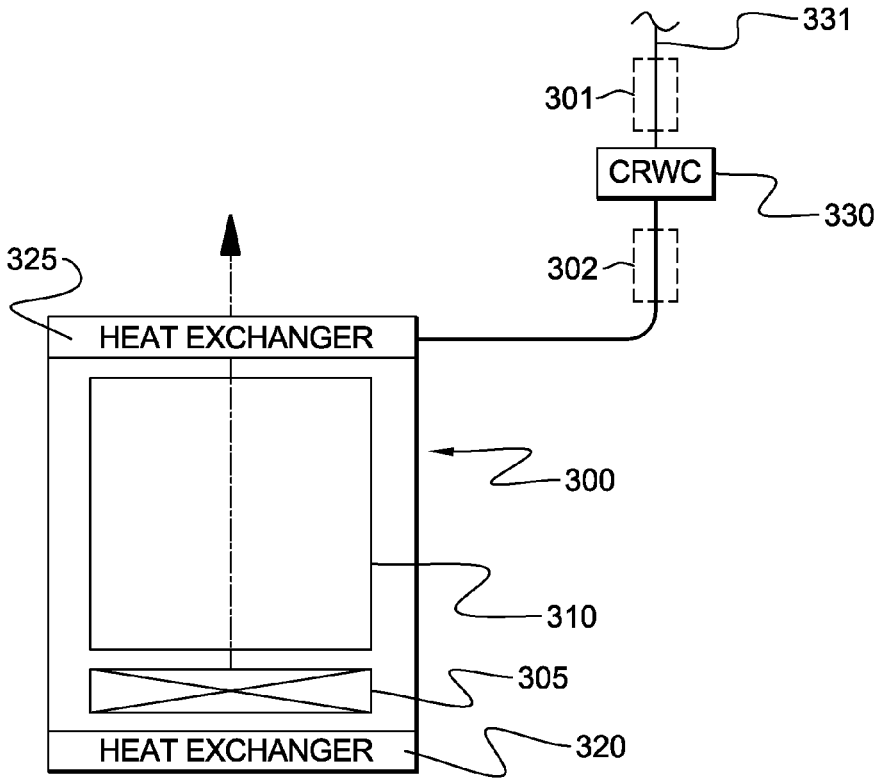
FIG. 3A is a cross-sectional plan view of one embodiment of an electronics rack using attached air-to-liquid heat exchangers to enhance cooling of air passing through the electronics rack, in combination with one or more fluid-driven, electricity-generating systems, in accordance with one or more aspects of the present invention.
Figure 3B:
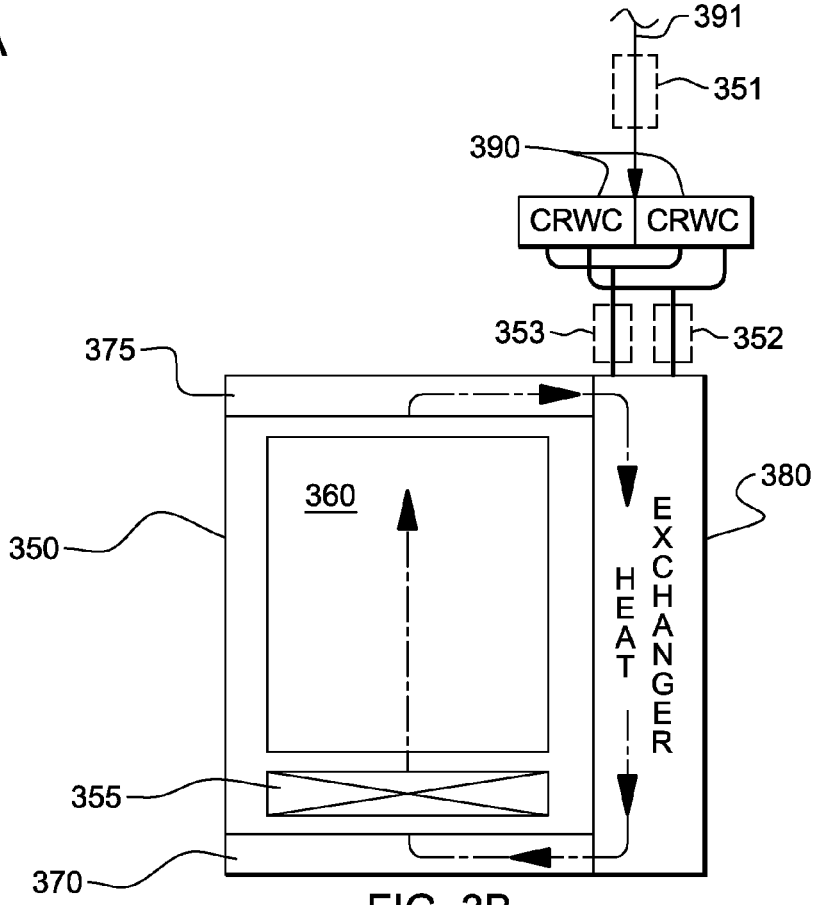
FIG. 3B is a cross-sectional plan view of another embodiment of an electronics rack using an attached air-to-liquid heat exchanger to enhance cooling of air passing through the electronics rack, in combination with one or more fluid-driven, electricity-generating systems, in accordance with one or more aspects of the present invention.

FIGS. 3A and 3B depict different rack level liquid cooled solutions which utilize, for example, chilled facility water to remove heat from the computer installation room, thereby transferring the cooling burden from the air-conditioning units to the building chilled water coolers. Certain aspects of the embodiment of FIG. 3A are described in detail in commonly assigned U.S. Pat. No. 6,819,563, while various aspects of the embodiment of FIG. 3B are described in detail in commonly assigned U.S. Pat. No. 6,775,137. Briefly summarized, both embodiments utilize a computer room water conditioning unit 330 (FIG. 3A), 390 (FIG. 3B) (fed with facility chilled water 331 (FIG. 3A), 391 (FIG. 3B)), which circulates chilled coolant through one or more heat exchangers coupled to or associated with individual electronics racks 300, 350 within the computer room.

In the embodiment of FIG. 3A, electronics rack 300 has an inlet heat exchanger 320 and/or an outlet heat exchanger 325 attached to the rack. Airflow across one or more electronics drawers 310 is forced via one or more air moving devices 305. Each heat exchanger 320, 325 covers the complete airflow paths from front to back, with the air intake being chilled by heat exchanger 320, and the heated exhaust chilled by heat exchanger 325. Thus, the inlet-to-outlet airflow paths through the rack unit each pass through the same sequence of heat exchangers.

In FIG. 3B, rack unit 350 again includes one or more air moving devices 355 for moving airflow from an air inlet side to an air outlet side across one or more drawer units 360 containing the heat generating components. In this embodiment, a front cover 370 attached to the rack covers the air inlet side, a back cover 375 attached to the rack covers the air outlet side thereof, and a side car attached to the rack includes a heat exchanger 380 for cooling of the air circulating through the rack unit. Further, in this embodiment, multiple computer room water conditioning (CRWC) units 390 receive building or facility chilled water 391, which is then used to cool coolant circulating through heat exchanger 380. The rack unit in this example is assumed to comprise a substantially enclosed housing wherein the same air circulates through the housing and passes across the heat exchanger 380.

In the embodiments illustrated, one or more fluid-driven, electricity-generating systems are optionally disposed in fluid communication with one or more of the fluid transport pipes within the data center. For example, in the embodiment of FIG. 3A, one or more fluid-driven, electricity generating systems 301, 302 may be coupled in fluid communication with the facility coolant loop feeding CRWC unit 330, and/or coupled in fluid communication with the system coolant loop, which provides system coolant from CRWC 330 to one or both heat exchangers 320/325. In the embodiment of FIG. 3B, one or more fluid-driven, electricity-generating systems 351, 352, 353 may optionally be provided in fluid communication with either in the facility chilled water loop 391, or one or more of the system coolant loops coupling CRWC units 390 to heat exchanger 380. Advantageously, there are typically well defined specifications for pressure and flow of fluid (for example, water) through a facility coolant loop and a system coolant loop such as depicted in a connection with the embodiments of FIGS. 3A & 3B. Thus, one or more fluid-driven, electricity-generating systems, such as described herein below, may be coupled in fluid communication with one or more of these loops in order to generate electricity for powering, for example, one or more sensors or other control circuits disposed within or associated with the data center comprising the electronics rack 300, (FIG. 3A), 350 (FIG. 3B).

Figure 4:
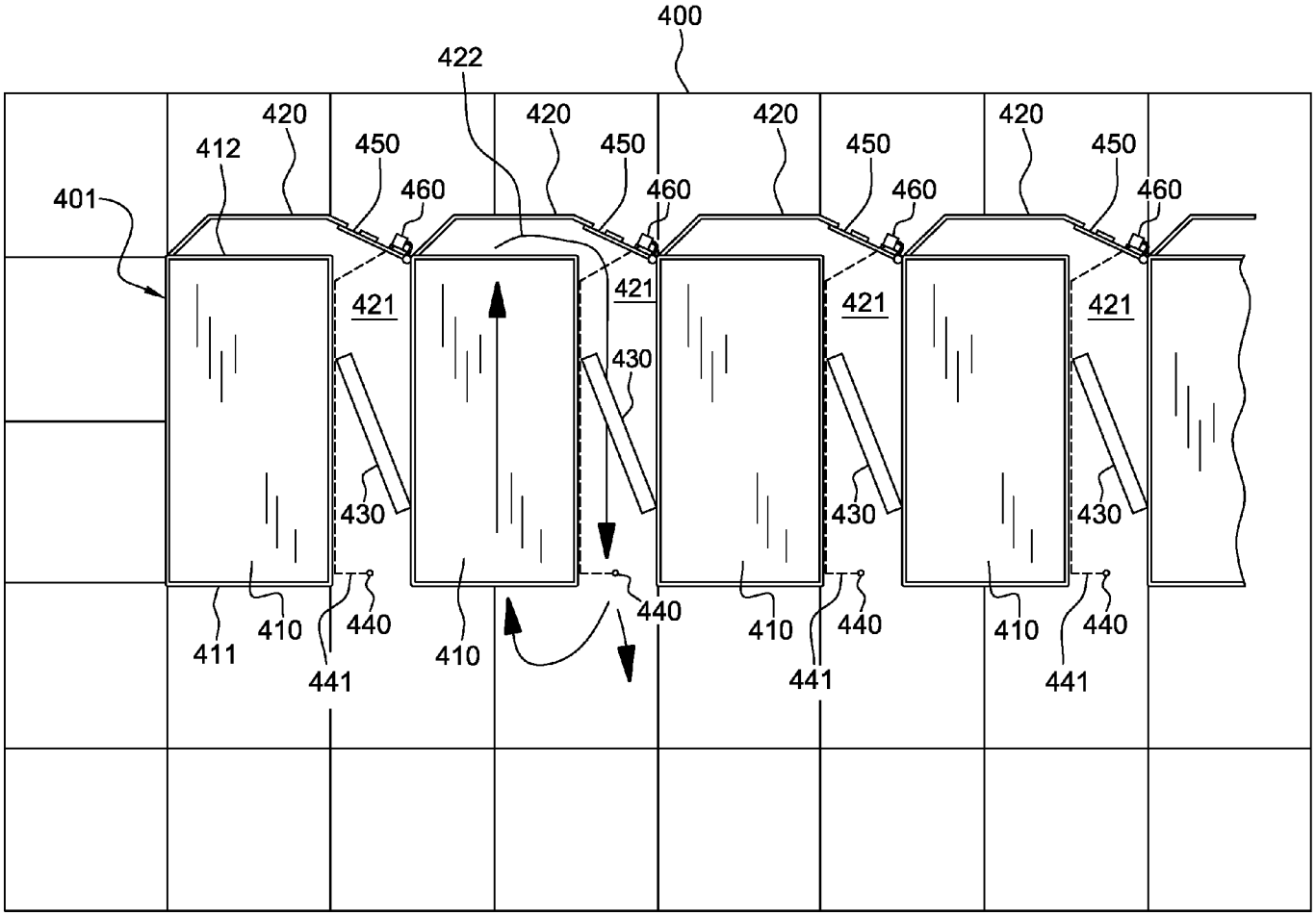
FIG. 4 is a plan view of one embodiment of a data center comprising multiple cooled electronic systems, each comprising an electronics rack and an associated airflow recirculation and cooling apparatus and shown in combination with one or more fluid-driven, electricity-generating systems, in accordance with one or more aspects of the present invention.

By way of further enhancement, depicted in FIG. 4 is an alternate airflow recirculation and cooling apparatus and method which ameliorates localized hot air temperatures at one or more rack units due to recirculating air currents. In the embodiment disclosed, the hot exhaust air from the air outlet side of the electronics rack is cooled and redirected to the air inlet side of the electronics rack to exhaust into the cold air aisle of the data center. At this location, the redirected airflow mixes with the air of the data center and is drawn back into the air inlet side of the electronics rack. Note that, this apparatus may be used in a data center wherein substantially all heat is extracted from the air via the air-to-liquid heat exchange assembly of the apparatus, or can be used in combination with a conventional air cooled data center, such as in an air cooled raised floor data center, wherein the cold air aisle includes perforated floor tiles through which cold air is forced by the air conditioning unit(s) of the data center.

Figure 5:
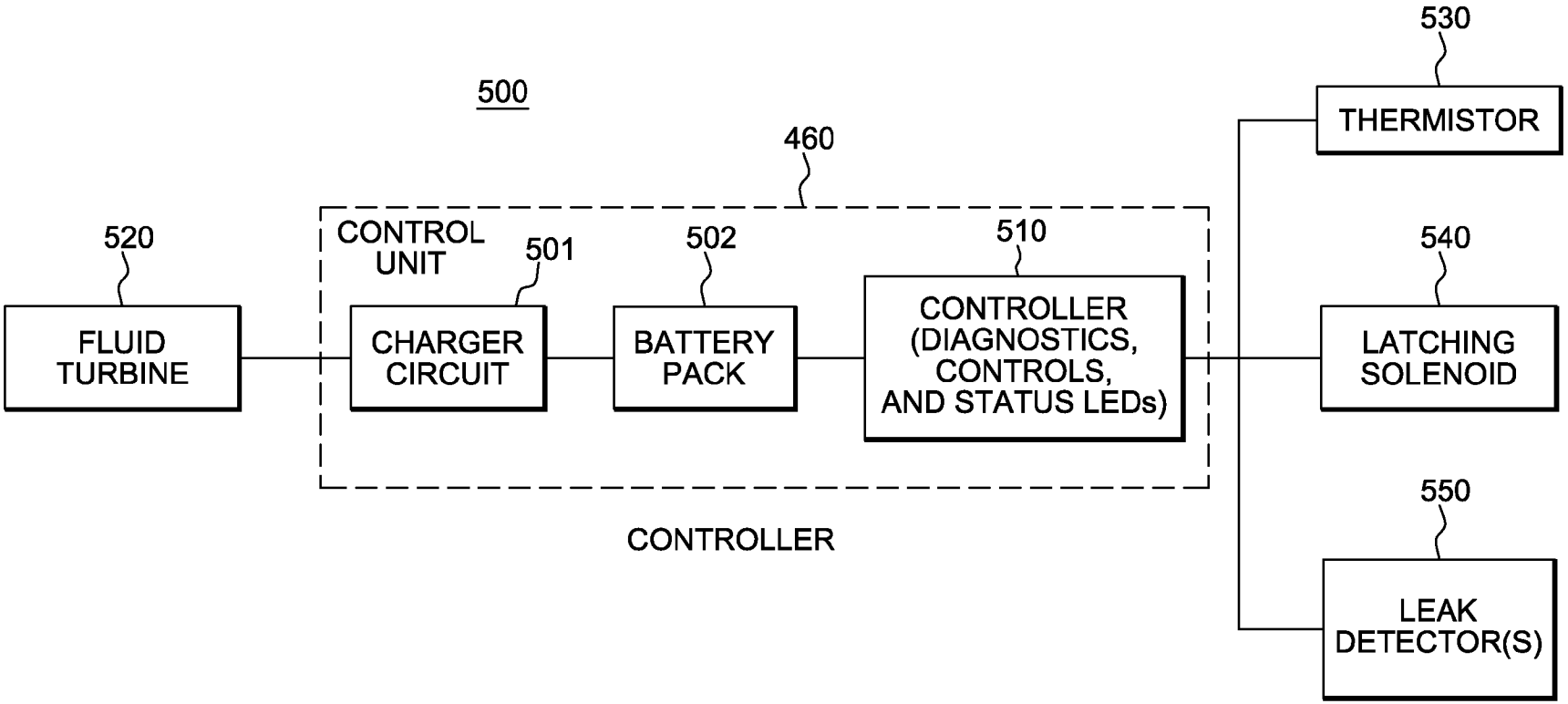
FIG. 5 is a schematic of one embodiment of a sense and control circuit for the airflow recirculation and cooling apparatus of FIG. 4, shown powered by one or more fluid-driven, electricity-generating systems, in accordance with one or more aspects of the present invention.

Advantageously, and as shown in FIGS. 4 & 5, the airflow recirculation and cooling apparatus disclosed, employs a controller which facilitates a plurality of functions. For example, one or more temperature sensors may be employed to monitor air temperature of the redirected airflow within the airflow return pathway, and responsive to this monitoring, an isolation door associated with an airflow director of the apparatus may be automatically transitioned to block airflow exhausting from the air outlet side of the electronics rack from passing through the airflow return pathway back towards the air inlet side of the electronics rack. In one embodiment, this might occur responsive to the sensed temperature of the redirected airflow exceeding a predefined temperature threshold. Additionally, the controller may automatically transition the isolation door to block exhaust airflow from the air outlet side of the electronics rack from passing through the airflow return pathway should a leak be detected in the one or more air-to-liquid heat exchange assemblies within the airflow return pathway.

One or more power sources, such as one or more of the fluid-driven, electricity-generating systems disclosed herein, are employed to power the controller. By way of example, the fluid-driven, electricity-generating system(s) may be employed in fluid communication with any fluid transport pipe associated with cooling the electronics rack or the data center.

The cooling apparatus disclosed herein may either supplement conventional air cooling of a data center, or replace the air cooling of the data center, depending on the requirements of the implementation. Further, the apparatuses and methods disclosed herein, particularly when used as a supplement to conventional air cooling, allow the associated electronics rack to continue operation notwithstanding detection of a problem with the one or more heat exchange assemblies within the airflow return pathway of the apparatus.

FIG. 4 is a plan view of a data center floor 400. In one embodiment, data center floor 400 is a raised floor implementation comprising perforated tiles (not shown) in a cold air aisle of the data center adjacent to the air inlet sides of the electronics racks, shown arranged in a row. In such an implementation, air cooling of the rack units is provided by one or more air conditioning units (not shown) of the data center.

In FIG. 4, data center floor 400 has disposed thereon multiple cooled electronics systems 401, in accordance with aspects of the present invention. Each cooled electronics system 401 comprises (in one embodiment) an air cooled electronics rack 410 and an open loop, airflow recirculation and cooling apparatus for redirecting and cooling exhausting air of the electronics rack 410. As illustrated, each electronics rack 410 includes an air inlet side 411 and an air outlet side 412, which respectively enable ingress and egress of external air. In addition, each electronics rack includes one or more electronics subsystems requiring cooling, and one or more air moving devices (not shown), which cause external air to flow from air inlet side 411, across the one or more electronics subsystems thereof to air outlet side 412. The airflow recirculation and cooling apparatus of the present invention is shown to define an open loop wherein airflow 422 exhausting from electronics rack 410 at the air outlet side 412 thereof is redirected via an airflow redirector 420 through an airflow return pathway 421, across an air-to-liquid heat exchange assembly 430, before exiting back into the data center to mix with air of the data center near air inlet side 411 of electronics rack 410. As shown, a portion of the redirected airflow exiting back into the data center is drawn back into the air inlet side 411 of electronics rack 410 to repeat the process. Note that the hot exhaust air from the air outlet side of the electronics rack is turned 180° in the airflow return pathway and flows along a side of the electronics rack extending transverse to air inlet side 411 and air outlet side 412 thereof.

As shown in FIG. 4, the airflow recirculation and cooling apparatus further includes one or more temperature sensors 440 for monitoring air temperature of the redirected airflow, and an automated isolation door 450 associated with airflow director 420 to automatically, selectively block airflow exhausting from air outlet side 412 of electronics rack 410 from passing through airflow return pathway 421 back towards air inlet side 411 of the electronics rack. As shown, temperature sensor(s) 440 connects via one or more communications lines 441 back to a control unit 460, which controls (via a latching mechanism) position of the automated isolation door. By way of example, the one or more temperature sensors might comprise one or more thermistors.

Note that various embodiments of the airflow recirculation and cooling apparatus conceptually depicted in FIG. 4 are possible. One or more variations to this apparatus may be possible, without departing from the scope of the present invention. For example, less than all air egressing from the air outlet side of the electronics rack may be redirected into the airflow return pathway, depending on the requirements of the implementation. This could be achieved by providing one or more exposed openings in the airflow director 420 sufficient to allow a desired amount of air to egress through the apparatus adjacent to the air outlet side of the electronics rack.

FIG. 5 depicts one embodiment of a detection and control circuit for the cooling apparatus depicted in FIG. 4. In this embodiment, circuit 500 is shown to include control unit 460 which operates a controller 510, a battery pack 502 (powering the controller), and a charger circuit 501 (for charging the battery pack). In one embodiment, charger circuit 501 is powered by a fluid turbine 520 of a fluid-driven, electricity-generating system (such as disclosed herein) disposed within a fluid transport pipe of the data center. For example, the electricity-generating system may comprise a field replaceable unit 301, 351 (shown in FIGS. 3A & 3B) that is disposed in fluid communication with facility chilled water (e.g., water line 331 of FIG. 3A, 391 of FIG. 3B, or facility chilled water to heat exchangers 430 of FIG. 4) or a field replaceable unit 302, 352, 353 (shown in FIGS. 3A & 3B) disposed in fluid communication with one or more secondary coolant lines, such as the coolant lines connecting CRWC 330 to heat exchanger 325 in FIG. 3A or CRWC 390 to heat exchanger 380 in FIG. 3B or connecting any CRWC or other conditioning unit in fluid communication with one or more of the heat exchangers 430 in the embodiment of FIG. 4. When operatively disposed in fluid communication with a fluid transport pipe of the data center, the fluid-driven, electricity-generating system provides (in one embodiment) power to charger circuit 501. By way of specific example, the battery pack may comprise lithium ion batteries and the charger circuit a lithium ion battery charger. Advantageously, such a configuration ensures a constant and reliable source of power for any sensor and control circuitry, for example, associated with the electronics rack or the data center.

In FIG. 5, controller 510 is coupled, by way of example, to one or more thermistors 530, e.g., to sense airflow of the redirected airflow in the embodiment of FIG. 4 where, for example, the redirected airflow egresses to mix with air of the data center near the air inlet side of the electronics rack. Additionally, controller 510 may be connected to one or more leak detectors 550 disposed, for example, in a pan at the bottom of the air-to-liquid heat exchange assembly for detecting a coolant leak. If either a coolant leak in the heat exchange assembly is detected or an airflow over temperature condition is noted, then controller 510 may activate a latching solenoid 540 associated with the automated isolation door 450 (FIG. 4) described above, to retract, for example, a retractable pin and allow the isolation door to swing from its first position to the second position.

FIGS. 6-10 present another embodiment of a data center comprising an electronics rack with a liquid-cooled heat exchanger associated therewith. In this embodiment, the liquid-cooled heat exchanger resides at a rear door of the electronics rack.

Figure 6:
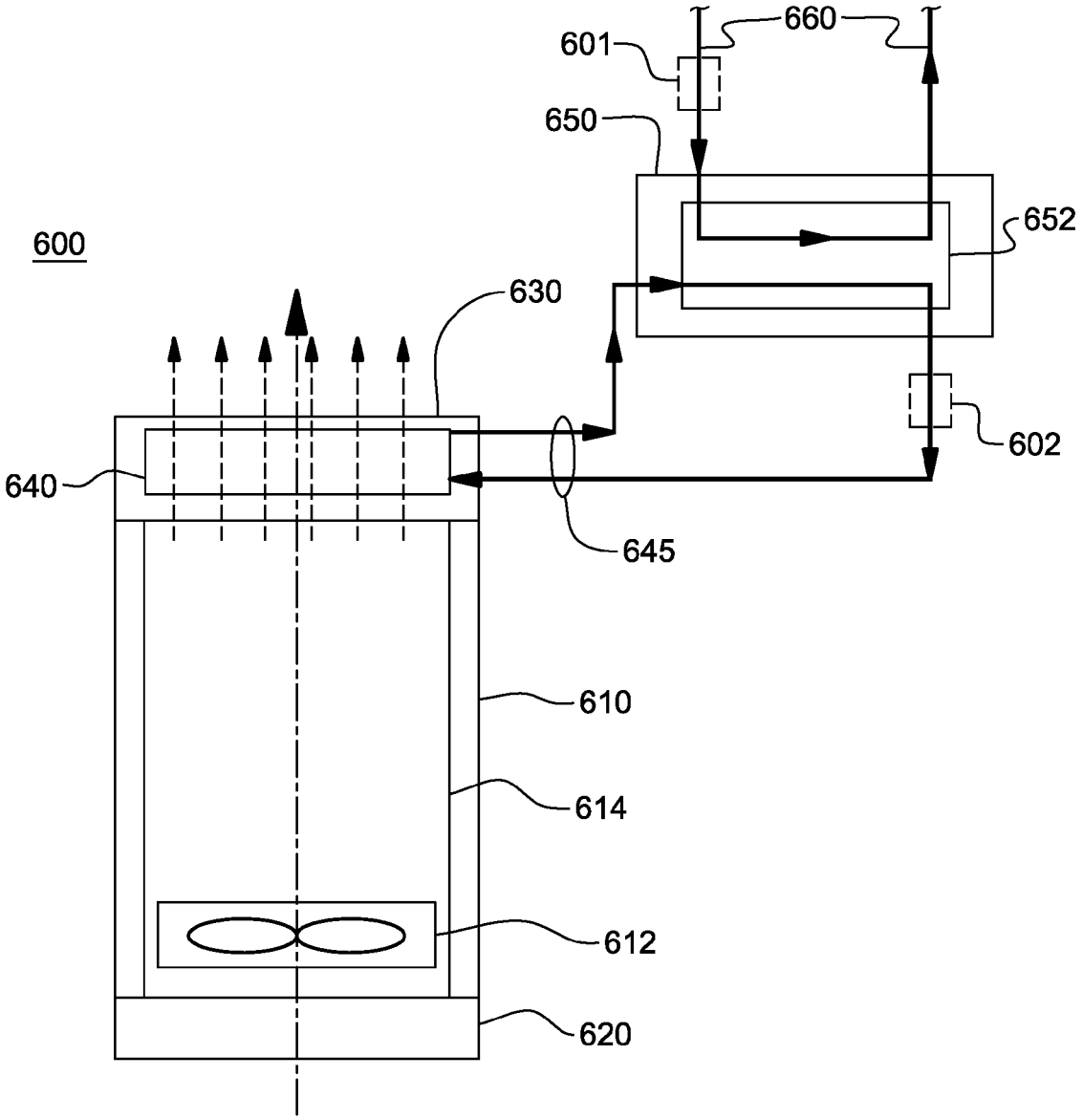
FIG. 6 is a top plan view of one embodiment of an electronics rack with an alternate embodiment of a cooling apparatus, in combination with one or more fluid-driven, electricity-generating systems, in accordance with one or more aspects of the present invention.

FIG. 6 depicts one embodiment of a cooled electronics system, generally denoted 600, in accordance with an aspect of the present invention. In this embodiment, electronics system 600 includes an electronics rack 610 having an inlet door 620 and an outlet door 630, which respectively have openings to allow for the ingress and egress of external air, respectively, through the air inlet side and air outlet side of electronics rack 610. The system further includes at least one air-moving device 612 for moving external air across at least one electronics subsystem 614 positioned within the electronics rack. Disposed within outlet door 630 is an air-to-liquid heat exchanger 640 across which the inlet-to-outlet airflow through the electronics rack passes. A cooling unit 650 is used to buffer the air-to-liquid heat exchanger from facility coolant 660, for example, provided via a coolant distribution unit (not shown). Air-to-liquid heat exchanger 640 removes heat from the exhausted inlet-to-outlet airflow through the electronics rack via the system coolant, for ultimate transfer in cooling unit 650 to facility coolant 660 via liquid-to-liquid heat exchanger 652 disposed therein. This cooling apparatus advantageously reduces heat load on existing air-conditioning units within the data center, and facilitates cooling of electronics racks by cooling the air egressing from the electronics rack and thus cooling any air recirculating to the air inlet side thereof.

As shown in FIG. 6, a system coolant loop 645 couples air-to-liquid heat exchanger 640 to cooling unit 650. In one embodiment, the system coolant employed is water, and by way of example, such a cooled electronics system is described in U.S. Pat. No. 7,385,810 B2, issued Jun. 10, 2008, and entitled "Apparatus and Method for Facilitating Cooling of an Electronics Rack Employing a Heat Exchange Assembly Mounted to an Outlet Door Cover of the Electronics Rack".

In this patent, the inlet and outlet plenums mount within the door and are coupled to supply and return manifolds disposed beneath a raised floor. Presented hereinbelow are enhanced variations on such an outlet door heat exchanger. Specifically, disclosed hereinbelow is an air-to-liquid heat exchanger which employs a pumped refrigerant as the system coolant. Connection hoses for the pumped refrigerant system are, in one embodiment, metal braided hoses, and the system coolant supply and return headers for the pumped refrigerant system are mounted overhead relative to the electronics racks within the data center. Thus, for the pumped refrigerant system described below, system coolant enters and exits the respective system coolant inlet and outlet plenums at the top of the door and rack. Further, because pumped refrigerant is employed, the hose and couplings used in the pumped refrigerant systems described below are affixed at both ends, i.e., to the system coolant plenums on one end and to the overhead supply and return headers on the other end.

Advantageously, the coolant supply and return hoses disclosed herein reside over the electronics rack, are sufficiently flexible, at least partially looped and are sized to facilitate opening and closing of the door containing the air-to-liquid heat exchanger. Additionally, structures are provided at the ends of the hoses to relieve stress at the hose ends which results from opening or closing of the door.

By way of example, one or more fluid-driven, electricity-generating system(s) 601, 602 may be coupled in fluid communication with one or more fluid transport pipes associated with cooling unit 650 and/or air-to-liquid heat exchanger 640 of the cooled electronics system. In FIG. 6, fluid-driven, electricity-generating system 601 is coupled in fluid communication with the facility coolant loop 660, and one or more fluid-driven, electricity-generating system(s) 602 are illustrated coupled in fluid communication with system coolant loop 645.

Figure 7:
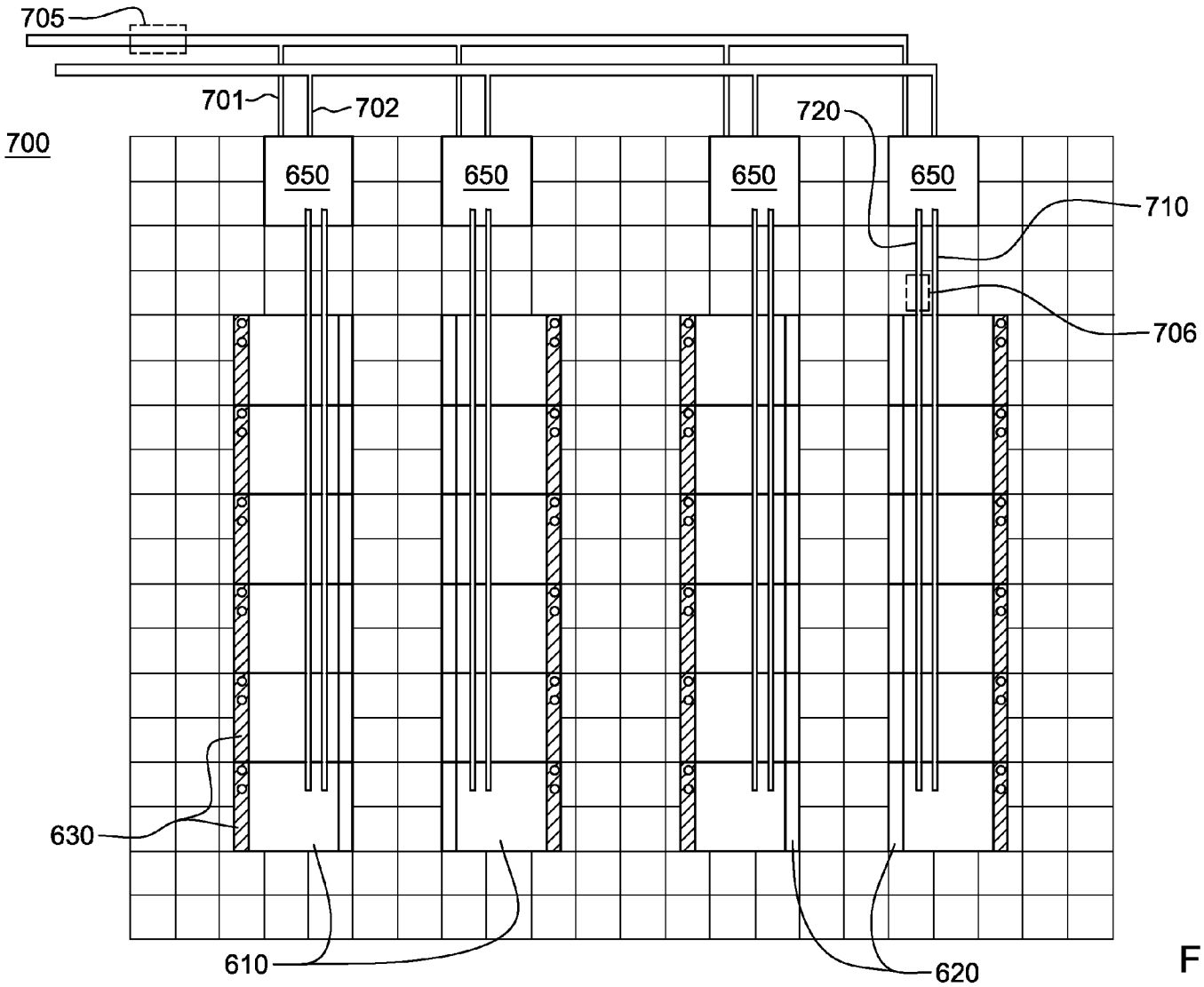
FIG. 7 is a top plan view of one embodiment of a data center employing cooling apparatuses comprising outlet door air-to-liquid heat exchangers, in combination with one or more fluid-driven, electricity-generating systems, in accordance with one or more aspects of the present invention.

FIG. 7 is a plan view of one embodiment of a data center, generally denoted 700, employing cooled electronics systems, such as depicted in FIG. 6. Data center 700 includes a plurality of rows of electronics racks 610, each of which includes an inlet door 620 and a hinged outlet door 630, such as described above in connection with the embodiment of FIG. 6. Each outlet door 630 supports an air-to-liquid heat exchanger and system coolant inlet and outlet plenums as described further below. Multiple cooling units 650, referred to hereinbelow as pumping units, are disposed within the data center (along with one or more air-conditioning units (not shown)). In this embodiment, each pumping unit forms a system coolant distribution subsystem with one row of a plurality of electronics racks. Each pumping unit includes a liquid-to-liquid heat exchanger where heat is transferred from a system coolant loop to a facility coolant loop. Chilled facility coolant, such as water, is received via facility coolant supply line 701, and is returned via facility coolant return line 702. System coolant, such as refrigerant, is provided via a system coolant supply header 710 extending over the respective row of electronics racks, and is returned via a system coolant return header 720 also extending over the respective row of electronics racks. In one embodiment, the system coolant supply and return headers 710, 720 are hard-plumbed within the data center, and preconfigured to align over and include branch lines extending towards electronics racks of a respective row of electronics racks.

Also shown in FIG. 7 are one or more fluid-driven, electricity-generating systems, in accordance with an aspect of the present invention. As illustrated, one or more fluid-driven, electricity-generating systems 705 may be employed in fluid communication with the plenum connected to coolant supply lines 701 or the plenum connected to coolant return lines 702, or to one or more of the coolant supply lines 701 or coolant return lines 702. Similarly, one or more fluid-driven, electricity-generating systems 706 may be coupled in fluid communication with one or more of the coolant supply headers 710 or coolant return headers 720, as desired to power one or multiple electronic devices disposed within or associated with the data center. These one or more fluid-driven, electricity-generating systems 705, 706 are also illustrated in FIG. 8.

Figure 8:
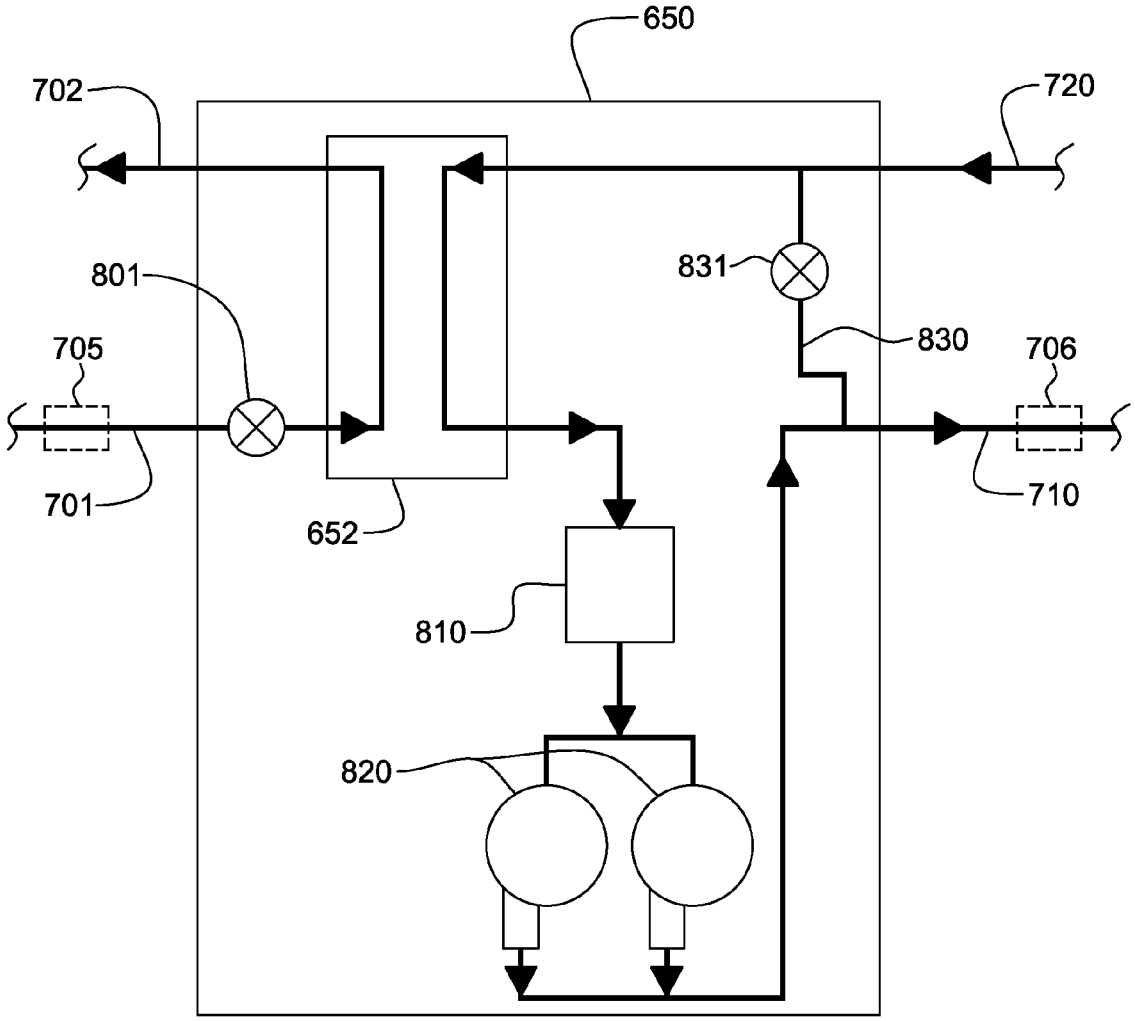
FIG. 8 is a schematic of one embodiment of a coolant distribution unit to be used in the data center of FIG. 7, in combination with one or more fluid-driven, electricity-generating systems, in accordance with one or more aspects of the present invention.

FIG. 8 depicts one embodiment of a cooling unit 650 for the data center 700 of FIG. 7. Liquid-to-liquid heat exchanger 652 condenses a vapor-liquid refrigerant mixture passing through the system coolant loop comprising system coolant supply header 710 and system coolant return header 720. (In one embodiment, the system coolant has undergone heating and partial vaporization within the respective air-to-liquid heat exchangers disposed within the outlet doors of the electronics racks.) The facility coolant loop of liquid-to-liquid heat exchanger 652 comprises facility coolant supply line 701 and facility coolant return line 702, which in one embodiment, provide chilled facility water to the liquid-to-liquid heat exchanger. A control valve 801 may be employed in facility coolant supply line 701 to control facility coolant flow rate through the liquid-to-liquid heat exchanger 652. After the vapor-liquid refrigerant mixture condenses within liquid-to-liquid heat exchanger 652, the condensed refrigerant is collected in a condensate reservoir 810 for pumping via a redundant pump assembly 820 back to the respective row of electronics racks via system coolant supply header 710. As shown in FIG. 8, a bypass line 830 with a bypass valve 831 may be employed to control the amount of system coolant fed back through the system coolant supply header, and hence, control temperature of system coolant delivered to the respective air-to-liquid heat exchangers mounted to the doors of the electronics racks.

Figure 9:
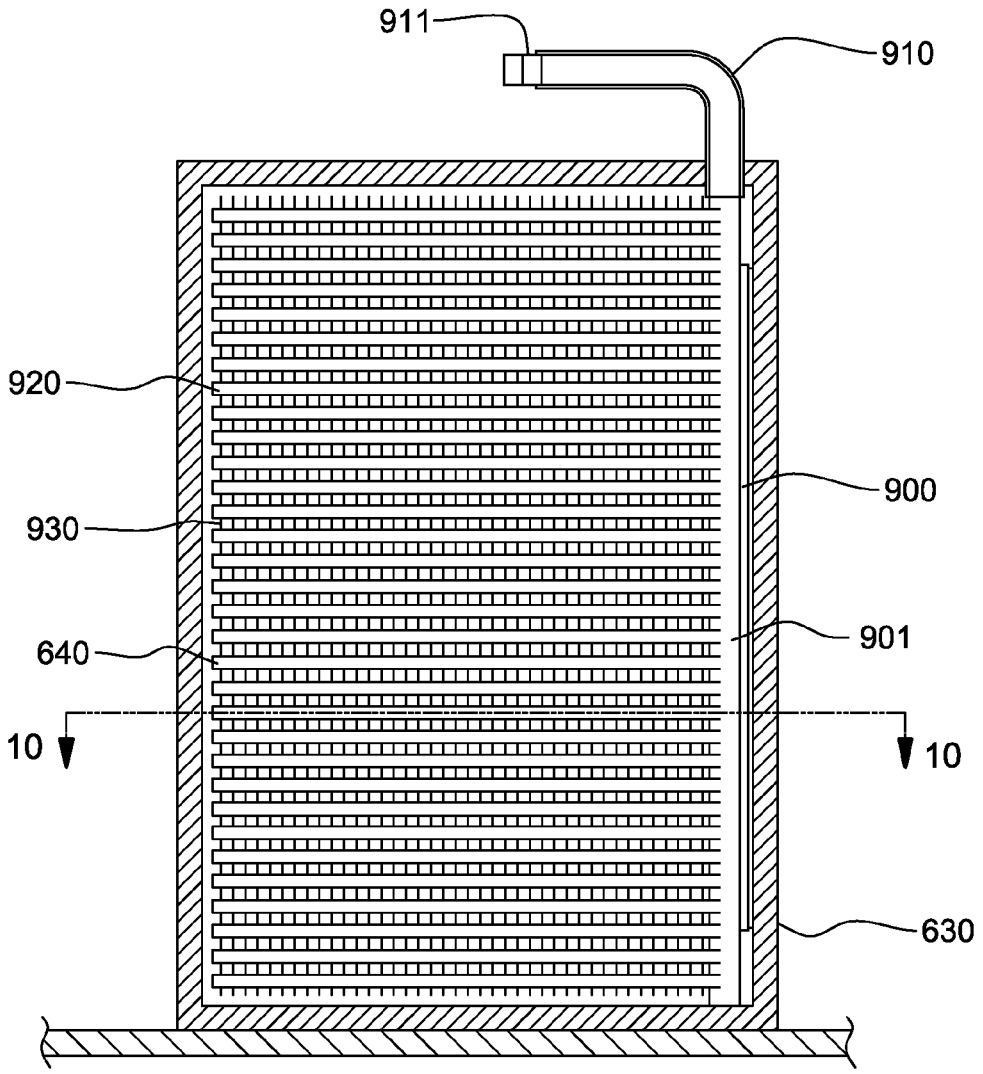
FIG. 9 is a partial cross-sectional, elevational view of one embodiment of electronics rack door and cooling apparatus mounted thereto, taken along line 9-9 in FIG. 10, in accordance with one or more aspects of the present invention.
Figure 10:
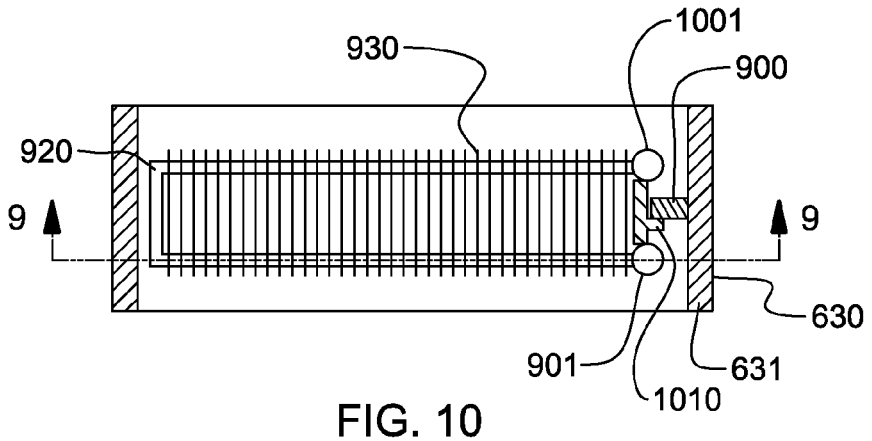
FIG. 10 is a cross-sectional, top plan view of the door and cooling apparatus of FIG. 9, taken along line 10-10, in accordance with one or more aspects of the present invention.

FIGS. 9 & 10 depict one embodiment of outlet door 630 supporting air-to-liquid heat exchanger 340, and system coolant inlet and outlet plenums 901, 1001. Referring to both figures collectively, outlet door frame 631 supports a rigid flap 900, which attaches, for example, by brazing or soldering, to a plate 1010 secured between the system coolant inlet plenum 901 and system coolant outlet plenum 1001.

In FIG. 9, right angle bend 910 is shown disposed at the top of system coolant inlet plenum 901. This right angle bend defines a horizontal inlet plenum portion, which extends above the top of door 630. The coolant inlet to system coolant inlet plenum 901 is coupled to a connect coupling 911 for facilitating connection thereof to the respective supply hose, as described above. The air-to-liquid heat exchanger comprises a plurality of horizontally-oriented heat exchange tube sections 920. These heat exchange tube sections 920 each comprise a coolant channel having an inlet and an outlet, with each coolant channel being coupled to the system coolant inlet plenum 901 and each coolant channel outlet being coupled to the system coolant outlet plenum 1001. A plurality of fins 930 are attached to horizontally-oriented heat exchange tube sections 920 for facilitating transfer of heat from air passing across the air-to-liquid heat exchanger to coolant flowing through the plurality of heat exchange tube sections 920. In one embodiment, the plurality of fins are vertically-oriented, rectangular fins attached to horizontally-oriented heat exchange tube sections 920.

As noted, one or more electricity-generating systems may be employed in fluid communication with one of the fluid transport pipes to provide a steady flow of electricity to, for example, a charger circuit and battery pack of a control unit, such as described above in connection with FIG. 5. This control unit can then be employed to facilitate diagnostics, control or status LEDs, etc., associated with operation of an air-to-liquid heat exchanger, the electronics rack or the data center within which the electronics rack resides. The field replaceable unit portion of the electricity-generating system could be coupled in fluid communication within any one of the various coolant transport pipes of the data centers described herein.

Figure 11:
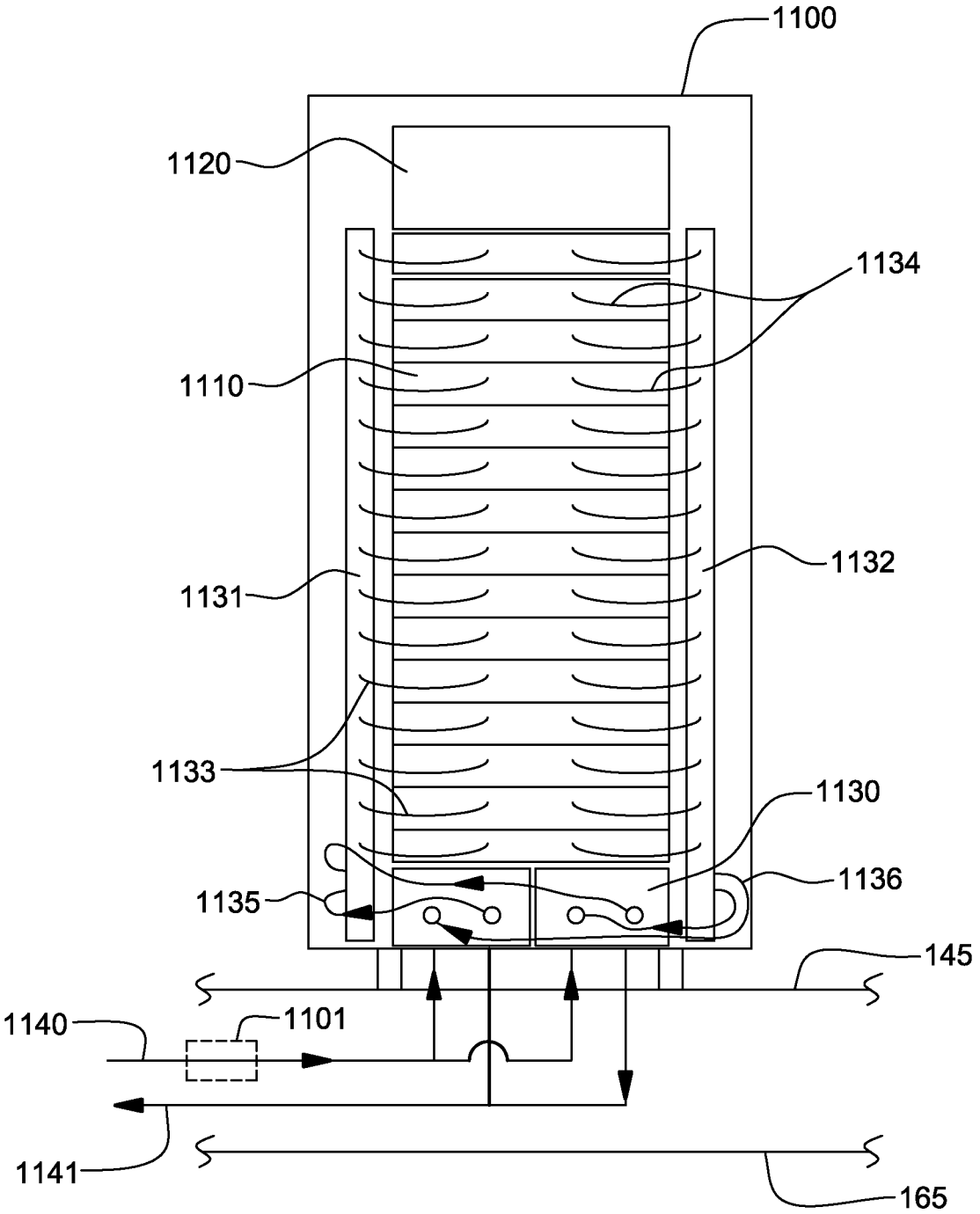
FIG. 11 is a front elevational view of another embodiment of a liquid-cooled electronics rack comprising multiple electronic subsystems cooled by a cooling apparatus, in combination with one or more fluid-driven, electricity-generating systems, in accordance with one or more aspects of the present invention.
Figure 12:
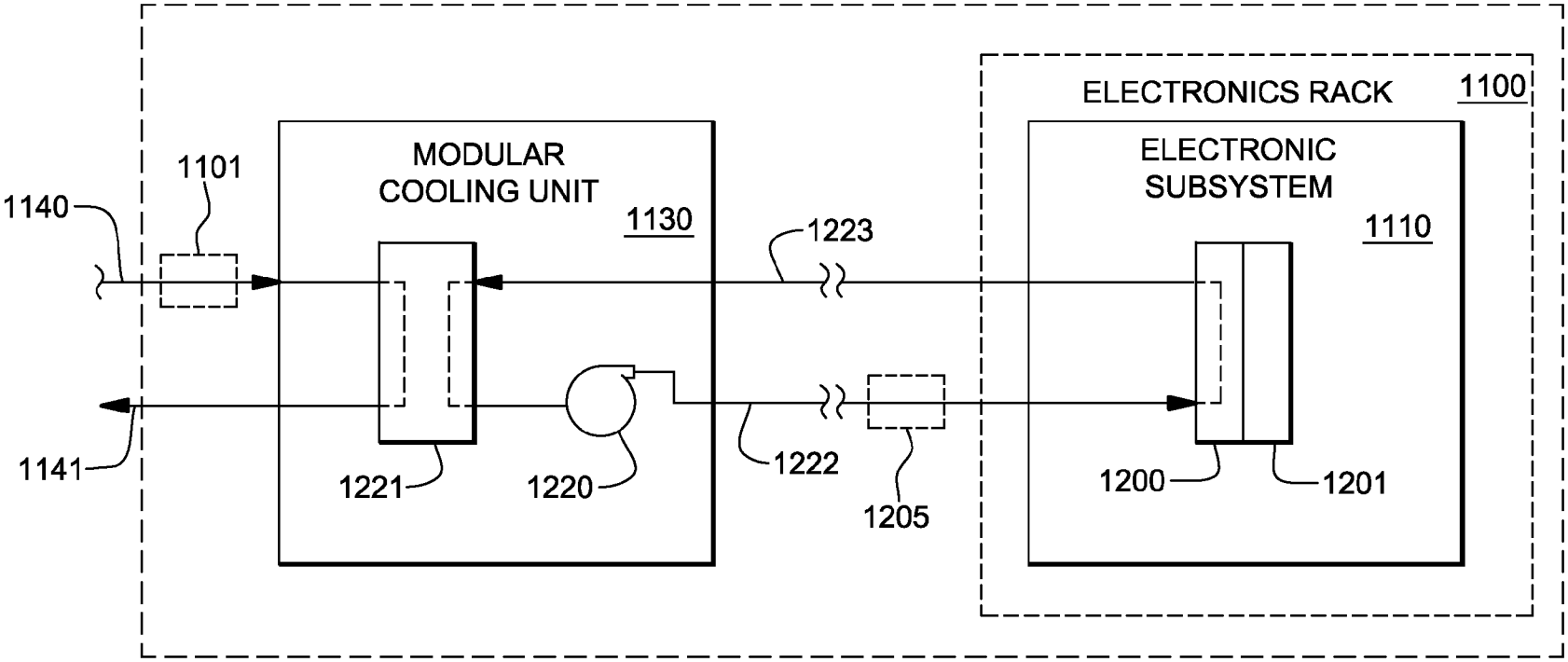
FIG. 12 is a schematic of one embodiment of an electronic subsystem of an electronics rack, wherein an electronics module is liquid-cooled by system coolant provided by one or more modular cooling units disposed within the electronics rack, and shown in combination with one or more fluid-driven, electricity-generating systems, in accordance with one or more aspects of the present invention.
Figure 13:
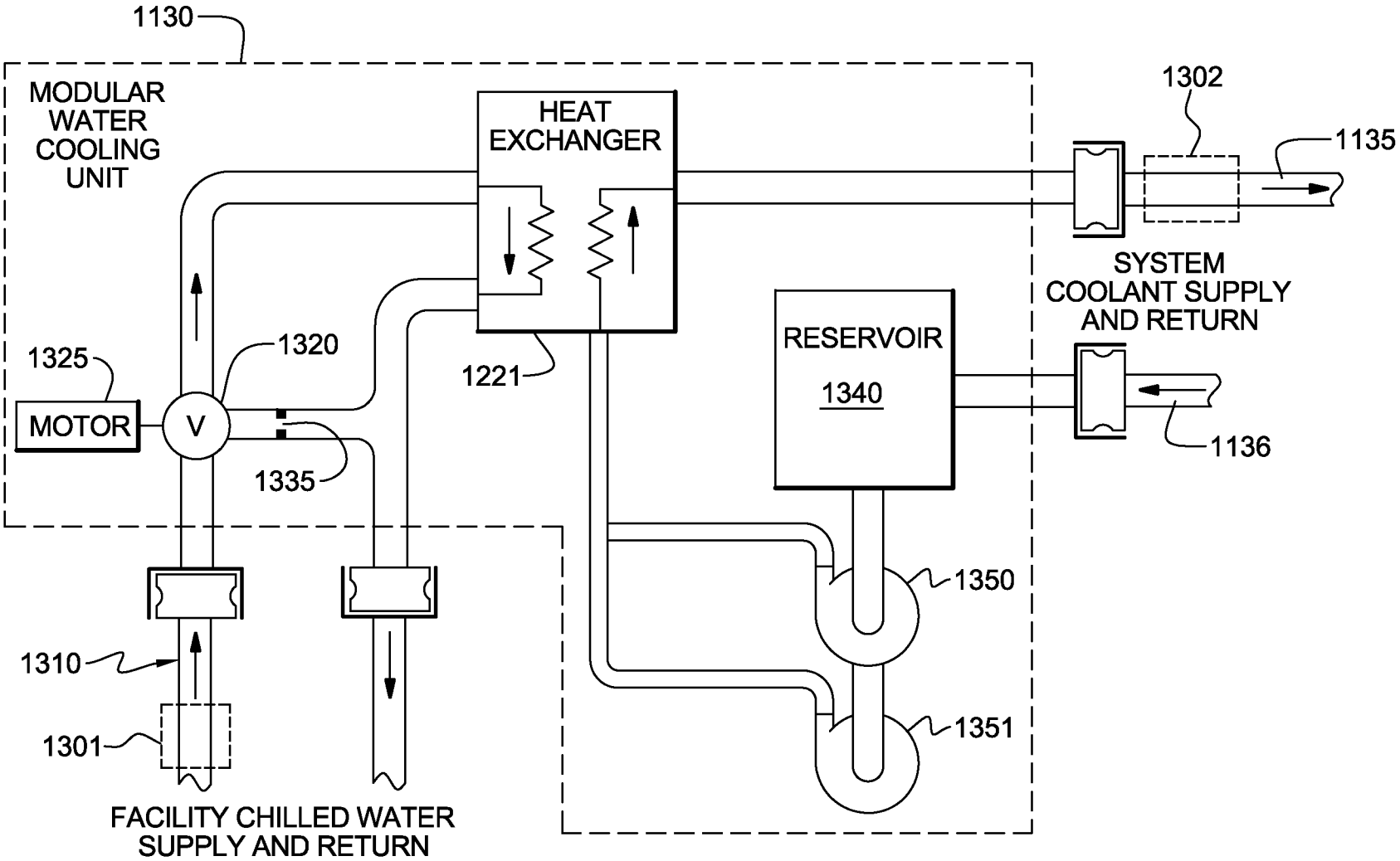
FIG. 13 is a schematic of one embodiment of a modular cooling unit disposed within a liquid-cooled electronics rack, in combination with one or more fluid-driven, electricity-generating systems, in accordance with one or more aspects of the present invention.

FIGS. 11-13 depict another embodiment of a liquid cooled electronics rack with which one or more fluid-driven, electricity-generating systems, in accordance with one or more aspects of the present invention, may be associated to facilitate powering sense or control circuitry associated with, for example, the cooling apparatus, the electronics rack or the data center within which the electronics rack resides.

FIG. 11 depicts one embodiment of a liquid-cooled electronics rack 1100 which employs a cooling system to be monitored and operated utilizing the systems and methods described herein. In one embodiment, liquid-cooled electronics rack 1100 comprises a plurality of electronics subsystems 1110, which may be processor or server nodes. A bulk power regulator 1120 is shown disposed at an upper portion of liquid-cooled electronics rack 1100, and two modular cooling units (MCUs) 1130 are disposed in a lower portion of the liquid-cooled electronics rack. In the embodiments described herein, the coolant is assumed to be water or an aqueous-based solution, again, by way of example only.

In addition to MCUs 1130, the cooling system includes a system water supply manifold 1131, a system water return manifold 1132, and manifold-to-node fluid connect hoses 1133 coupling system water supply manifold 1131 to electronics subsystems 1110, and node-to-manifold fluid connect hoses 1134 coupling the individual electronics subsystems 1110 to system water return manifold 1132. Each MCU 1130 is in fluid communication with system water supply manifold 1131 via a respective system water supply hose 1135, and each MWCU 1130 is in fluid communication with system water return manifold 1132 via a respective system water return hose 1136.

As illustrated, heat load of the electronics subsystems is transferred from the system water to cooler facility water supplied by facility water supply line 1140 and facility water return line 1141 disposed, in the illustrated embodiment, in the space between a raised floor 145 and a base floor 165.

In this embodiment, one or more fluid-driven, electricity-generating systems 1101 may be coupled in fluid communication with, for example, facility water supply line 1140 or facility water return line 1141. As described, the one or more fluid-driven, electricity-generating systems facilitate powering one or more electrical loads associated with, for example, sense and/or control circuitry of the cooling apparatus or other electrical load associated with the electronics rack, or the data center containing the electronics rack.

FIG. 12 schematically illustrates operation of the cooling system of FIG. 11, wherein a liquid-cooled cold plate 1200 is shown coupled to an electronics module 1201 of an electronics subsystem 1110 within the liquid-cooled electronics rack 1100. Heat is removed from electronics module 1201 via the system coolant circulated via pump 1220 through cold plate 1200 within the system coolant loop defined by liquid-to-liquid heat exchanger 1221 of modular water cooling unit 1130, lines 1222, 1223 and cold plate 1200. The system coolant loop and modular water cooling unit are designed to provide coolant of a controlled temperature and pressure, as well as controlled chemistry and cleanliness to the electronics module(s). Furthermore, the system coolant is physically separate from the less controlled facility coolant in lines 1140, 1141, to which heat is ultimately transferred.

FIG. 13 depicts a more detailed embodiment of a modular water cooling unit 1130, in accordance with an aspect of the present invention. As shown in FIG. 13, modular water cooling unit 1130 includes a first cooling loop wherein building chilled, facility coolant is supplied 1310 and passes through a control valve 1320 driven by a motor 1325. Valve 1320 determines an amount of facility coolant to be passed through heat exchanger 1221, with a portion of the facility coolant possibly being returned directly via a bypass orifice 1335. The modular water cooling unit further includes a second cooling loop with a reservoir tank 1340 from which system coolant is pumped, either by pump 1350 or pump 1351, into the heat exchanger 1221 for conditioning and output thereof, as cooled system coolant to the electronics rack to be cooled. The cooled system coolant is supplied to the system water supply manifold and system water return manifold of the liquid-cooled electronics rack via the system water supply hose 1135 and system water return hose 1136.

As with the above-described embodiments, one or more fluid-driven, electricity-generating systems such as described herein can be coupled in fluid communication with various fluid transport pipes within the data center. For example, the field replaceable unit portion 1101 (FIG. 11), 1205 (FIG. 12) of the electricity-generating system could be coupled in fluid communication with facility water supply line 1140 or facility water return line 1141 of FIG. 11, or the system coolant loop lines 1222, 1223 FIG. 12. Alternatively, the field-replaceable unit portion 1301, 1302 of the electricity-generating system could be coupled in fluid communication with the facility-chilled water supply line 1310, or the system coolant supply line 1135 of FIG. 13. Electricity generated by the electricity-generating system is fed, in one embodiment, to a charger circuit which charges a battery pack, such as described above in connection with the control unit embodiment of FIG. 5. Alternatively, electricity could be fed via a regulator circuit directly to a load to power the load, as required in association with an electronics rack or the data center within which the electronics rack resides.

Advantageously, the fluid-driven, electricity-generating systems described herein are miniature or micro systems configured as an inline field replaceable unit to facilitate coupling thereof in fluid communication with a fluid transport pipe of the data center. By way of example, the fluid-driven, electricity-generating system comprises a small hydro turbine which can be placed directly in line with any water (or other fluid) transport pipe of the data center to facilitate generating electrical power. Generation of electricity via the electricity-generating system imposes a minimal impedance and pressure drop within the respective fluid transport pipe. For example, in the well-regulated water systems of a data system, the fluid-driven, electricity-generating systems disclosed herein can be a very low cost and highly reliable source of alternative energy, and can be considered an exceptionally "green" alternative to disposable batteries. While providing considerable cost savings over annual replacement of disposable batteries.

Figure 14:
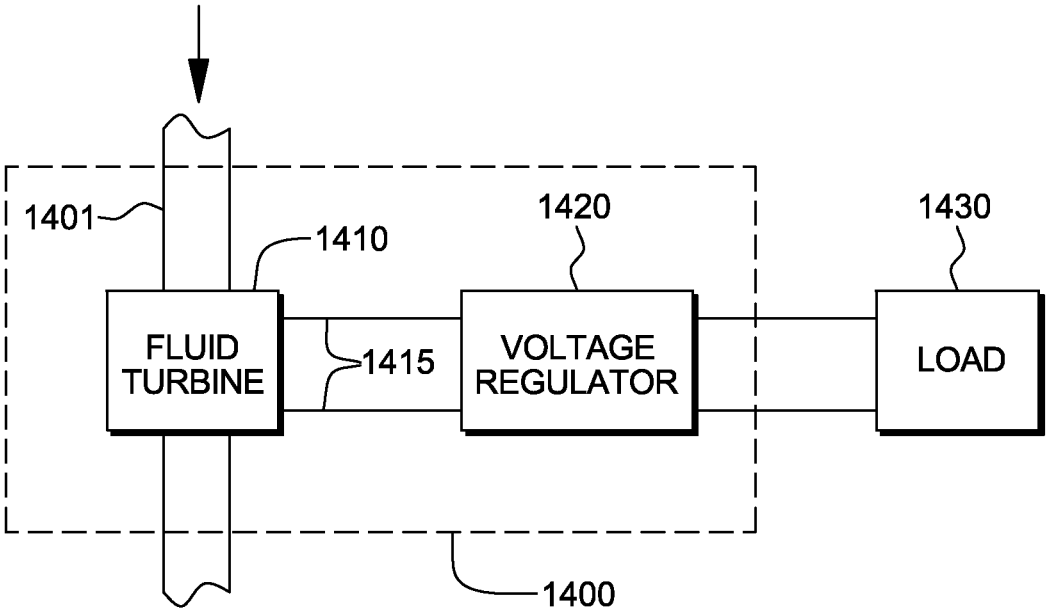
FIG. 14 is a schematic of one embodiment of a fluid-driven, electricity-generating system supplying electricity to an electrical load disposed, for example, within or associated with an electronics rack or data center, in accordance with one or more aspects of the present invention.

FIG. 14 depicts one embodiment of a data center, which includes one or more electronics racks (not shown), and one or more fluid transport pipes 1401. In one example, fluid transport pipe 1401 transports a coolant, such as water, to one or more cooling apparatuses associated with cooling the one or more electronics racks of the data center. The fluid-driven, electricity-generating systems 1400 disclosed herein includes a housing 1410 configured as a field replaceable unit, and comprising a fluid turbine coupled in fluid communication with fluid transport pipe 1401. This housing includes a first end and a second end, with the first end receiving fluid flowing through the fluid transport pipe 1401 and the second end returning the fluid to the fluid transport pipe 1401. As described further below, the fluid turbine of the electricity-generating system comprises an impeller disposed within the housing. The impeller is configured and positioned to turn with the flow of fluid across the impeller. In addition, at least one magnetic structure is disposed to turn with the turning of the impeller. The electricity-generating system further includes an electrical circuit 1415 coupled, for example, to a voltage regulator 1420. Electricity is generated within or for the electrical circuit with turning of the at least one magnetic structure, and the electrical circuit facilitates supplying the electricity to an electrical load 1430, for example, associated with one or more of the electronics rack within the data center or another load of the data center within which the electronics rack(s) resides.

FIGS. 15-19 illustrate various embodiments of a fluid-driven, electricity-generating system such as described herein. These embodiments facilitate the autonomous operation of electrical equipment independent of conventional sources of power (e.g., facilities power within a data center). In a first embodiment, depicted in FIGS. 15-16, a longitudinally-extending turbine is disclosed which includes an impeller mounted on a rotating spindle or shaft that is held in place by two mounting structures. The mounting structures maintain the internal impeller/shaft centered and contained within the structure, while allowing for the flow of fluid through the structure. This longitudally-extending implementation has one or more powerful magnets contained within the internal impeller/shaft structure. Externally, there is a wire wound coil wrapped at least partially around the external side of the housing structure. When the magnetic impeller/shaft turns under the flow of fluid, an alternating magnetic field is created which extends outside of the housing. The external coil and alternating magnetic field constitute a dynamo or electrical generator. The output from the coil is directed to a converter circuit such as voltage regulator 1420 (FIG. 14), and is then provided to, for example, a battery or other load, such as a wireless device load, which is thus advantageously powered independent of a data center's facility power.

Figure 17:
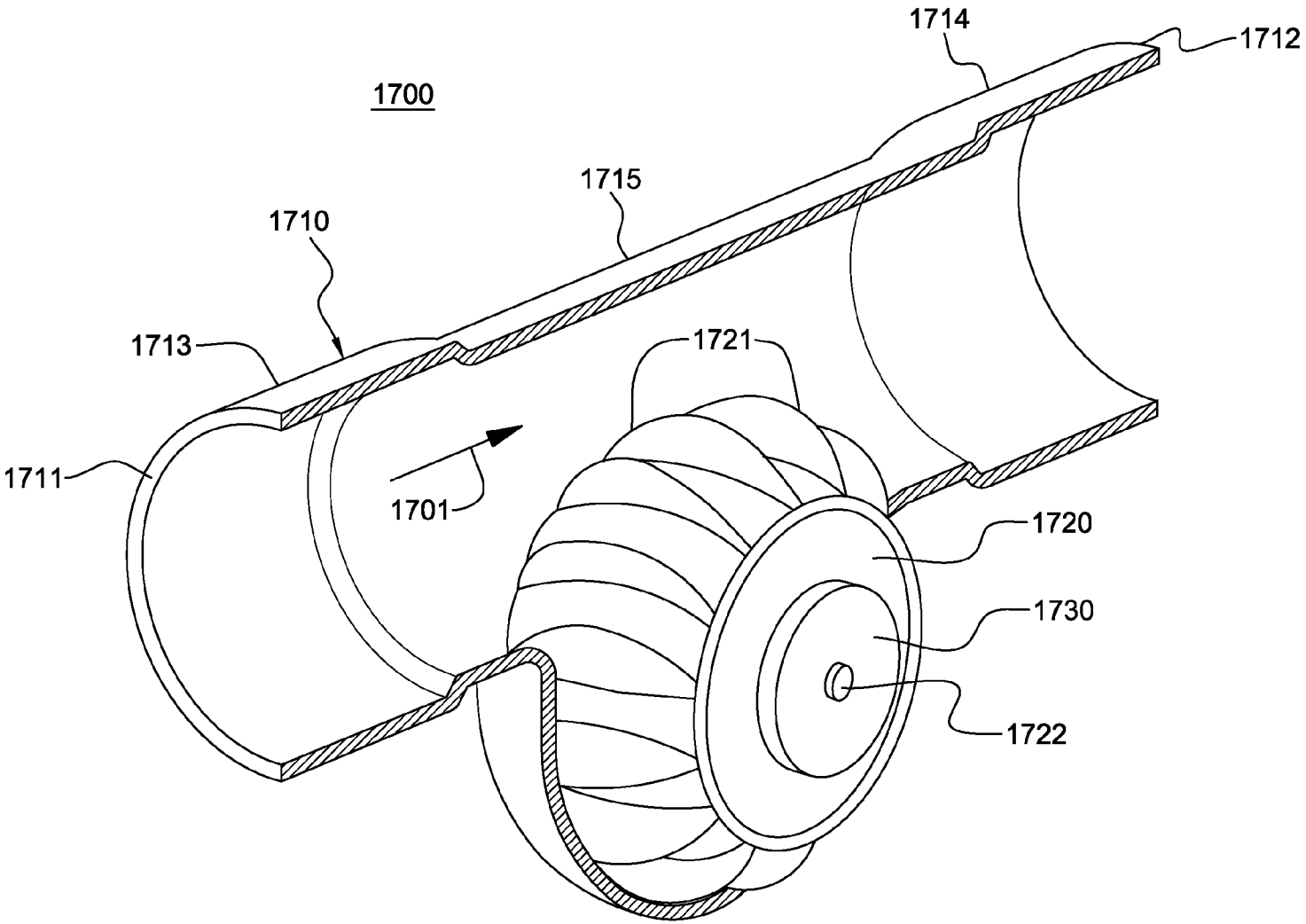
FIG. 17 is a partial cutaway depiction of an alternate embodiment of a fluid-driven, electricity-generating system, in accordance with one or more aspects of the present invention.
Figure 18:
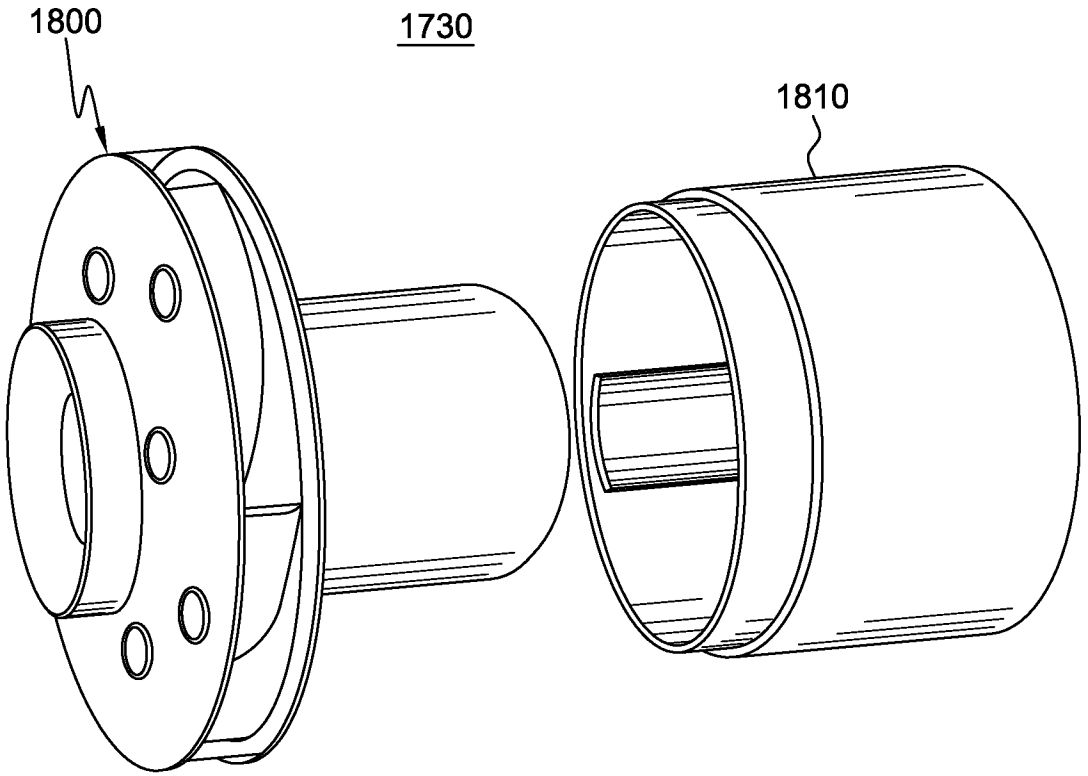
FIG. 18 depicts one embodiment of a magnetic coupler for the fluid-driven, electricity-generating system of FIG. 17, in accordance with one or more aspects of the present invention.
Figure 19:
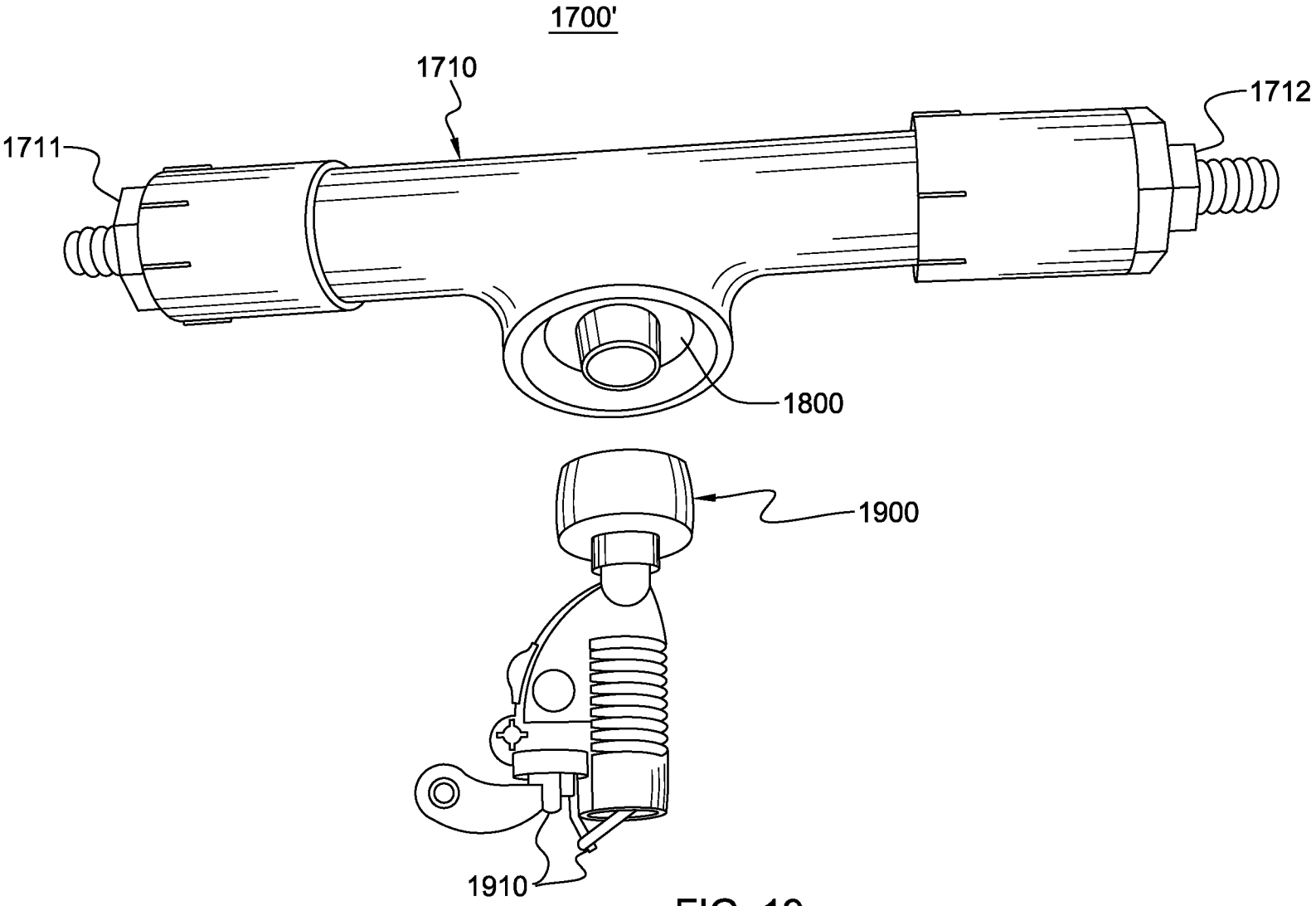
FIG. 19 depicts further details of one embodiment of the fluid-driven, electricity-generating system of FIGS. 17 & 18, and illustrating a dynamo disposed external to the housing, in accordance with one or more aspects of the present invention.

In the second implementation depicted in FIGS. 17-19, an axial turbine is employed which includes a paddle wheel (such as a Pelton paddle wheel), contained within a vessel or housing. The housing has an axle which holds the paddle wheel in position relative to fluid flow. Also attached to the paddle wheel is a "magnetic coupler", which allows an external dynamo to rotate along with the paddle wheel. The magnetic coupler allows a physical separation between the internal paddle wheel and the external dynamo. The external dynamo can be similar to a bicycle dynamo in design and fabrication. The output from the dynamo is connected to a converter circuit, such as voltage regulator 1420 (FIG. 14), which is electrically coupled to, for example, a battery, or other electrical equipment, such as a wireless device, etc.

Figure 15:
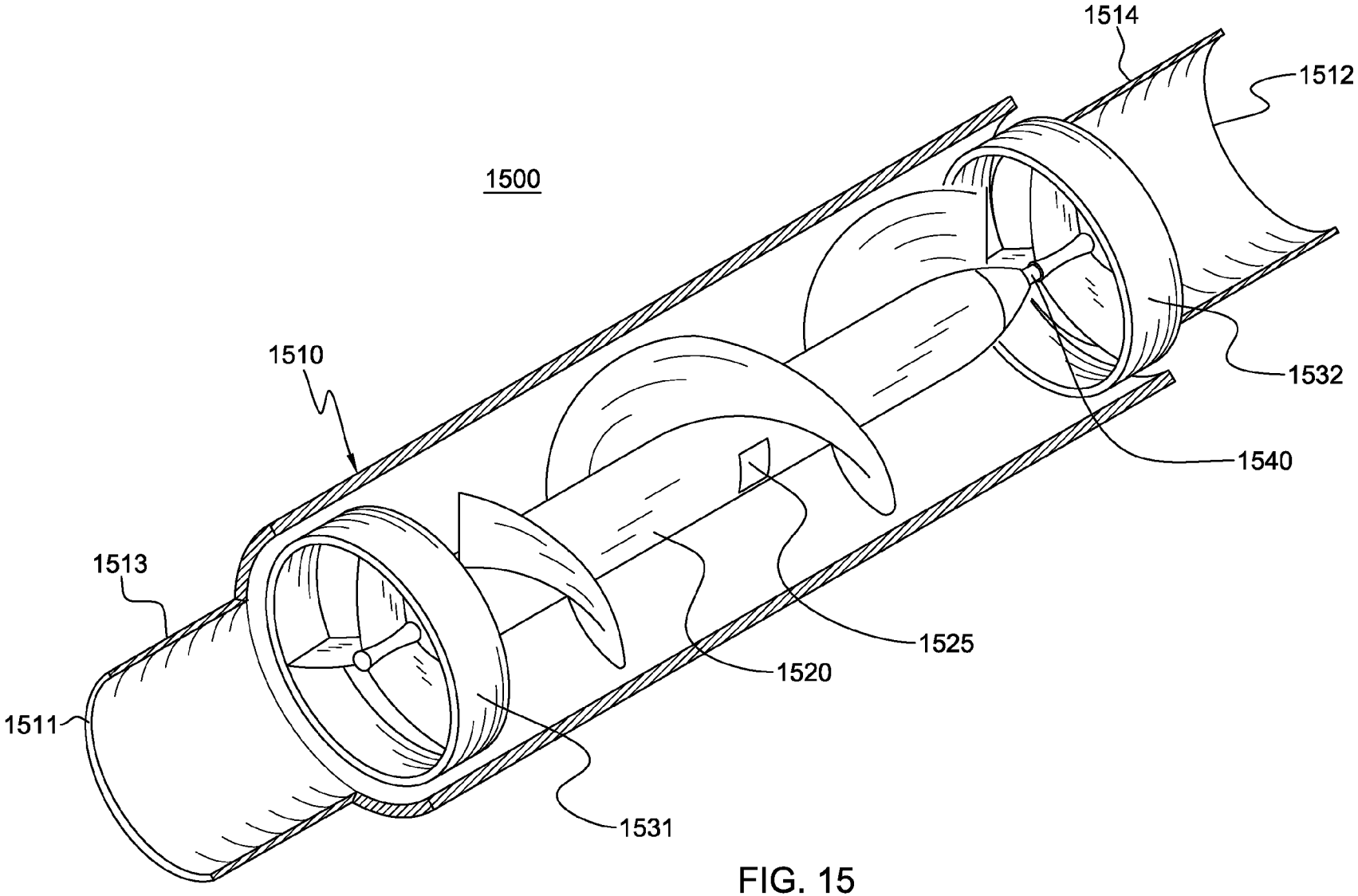
FIG. 15 depicts one embodiment of a longitudinally-extending impeller disposed within a housing of a fluid-driven, electricity-generating system, and configured to couple in fluid communication with a fluid transport pipe, and showing at least one magnetic structure disposed to turn with turning of the impeller, in accordance with one or more aspects of the present invention.
Figure 16:
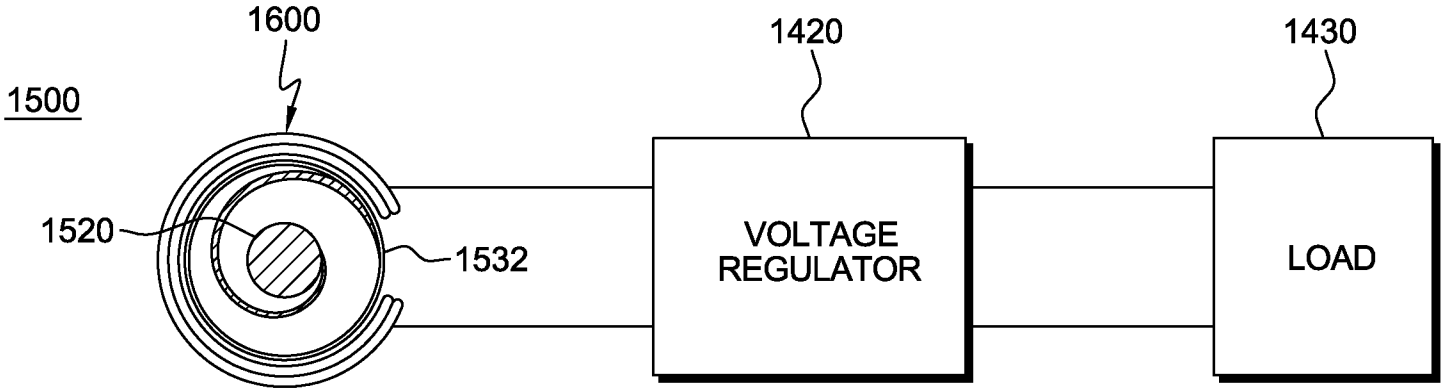
FIG. 16 is a schematic representation of a fluid-driven, electricity-generating system, such as partially shown in FIG. 15, which includes a wire-wound coil at least partially encircling the outside of the housing and shown electrically connected to a voltage regulator and an electrical load, in accordance with one or more aspects of the present invention.

As noted, FIGS. 15 & 16 depict one embodiment of a longitudinally-extending, fluid-driven, electricity-generating system 1500 which includes, in part, a field replaceable unit that comprises a housing 1510 with a first end 1511 and a second end 1512 configured to couple in fluid communication to a fluid transport pipe (such as described above in connection with FIGS. 3A-13), with the first end receiving fluid flowing through the fluid transport pipe and the second end returning the fluid to the fluid transport pipe. In this implementation, the housing 1510 includes a central region with a larger diameter than a diameter of the housing at a first end region 1513 adjacent to first end 1511 and a second end region 1514 adjacent to second end region 1512. This larger diameter facilitates minimizing pressure drop of fluid flowing though the fluid transport pipe where passing across an impeller 1520 within housing 1510.

In this configuration, impeller 1520 is mounted on a longitudinally-extending spindle 1540 which (in one embodiment) is positioned substantially coaxial with the fluid transport pipe when the housing is coupled in fluid communication with the fluid transport pipe. Longitudinally-extending spindle 1540 is maintained in position by a first (stationary) mounting structure 1531 and a second (stationary) mounting structure 1532 disposed at opposite ends of the longitudinally-extending spindle 1540. One or more relatively powerful magnets 1525 are positioned to turn with the turning of impeller 1520 or longitudinally-extending spindle 1540. For example, one or more magnets 1525 could be incorporated with impeller 1520 or longitudinally-extending spindle 1540 or, alternatively, attached to impeller 1520 or longitudinally-extending spindle 1540.

As illustrated in FIG. 16, one or more wire wound coils 1600 are disposed exterior to, and partially encircling, housing 1510, for example, in the region of magnet(s) 1525 associated with impeller 1520. In operation, turning of magnetic structure(s) 1525 with turning of impeller 1520 produces an alternating magnetic field which extends outside of housing 1510 to wire wound coil 1600, which generate(s) electricity within the wire wound coil. As illustrated in FIG. 16, wire wound coil 1600 is electrically connected to, for example, voltage regulator 1420, and a rechargeable battery or other electrical load 1430. Note that in alternate embodiments, multiple wire wound coils 1600 could be employed at least partially encircling housing 1510 in order to extract energy from the rotating magnetic field produced by rotation of magnetic structure(s) 1525.

As noted, FIGS. 17-19 depict an alternate embodiment of a fluid-driven, electricity-generating system, referred to herein as an axial turbine system, in accordance with one or more aspects of the present invention. In the embodiment illustrated, an axial turbine system 1700 is illustrated comprising a housing 1710 with a first end 1711 and a second end 1712 configured to couple in fluid communication with a fluid transport pipe (such as described above in connection with FIGS. 3A-13), with first end 1711 receiving fluid flowing through the fluid transport pipe and second end 1712 returning the fluid to the fluid transport pipe. Housing 1710 includes a central region 1715, and a first end region 1713 adjacent to first end 1711 and a second end region 1714 adjacent to second end 1712. In this embodiment, central region 1715 has a slightly smaller diameter than first end region 1713 and second end region 1714 to facilitate turning of paddle wheel 1720. A paddle wheel 1720 is (for example) a Pelton paddle wheel, and includes a plurality of paddles 1721 extending into the path 1701 of fluid flow through housing 1710, wherein the fluid flow turns paddle wheel 1720 about an axis 1722. In this configuration, the magnetic structure includes a magnetic coupler 1730, one embodiment of which is depicted in FIG. 18.

As illustrated in FIG. 18, magnetic coupler 1730 includes a first portion 1800 deposed internal to the turbine, i.e., the paddle wheel 1720 (FIG. 17), and an external portion 1810 attached to the generator (1900 in FIG. 19). In FIG. 19, one detailed embodiment of an axial electricity-generating system 1700' is illustrated, wherein the internal portion 1800 is shown within the paddle wheel, along with a generator 1900 partially exploded therefrom. Generator 1900 includes, in this example, the external portion 1810 (FIG. 18) of the magnetic coupler, and electricity is generated within generator 1900 for output via electrical connections 1910 to, for example, a voltage regulator 1420, such as illustrated in FIG. 14. By way of example, the generator 1900 may comprise a low voltage generator such as the Dymotec Sidewall Dynamos offered by Busch & Mueller of Meinerzhagen, Germany.

As will be appreciated by one skilled in the art, aspects of the controller described above may be embodied as a system, method or computer program product. Accordingly, aspects of the controller may take the form of an entirely hardware embodiment, an entirely software embodiment (including firmware, resident software, micro-code, etc.) or an embodiment combining software and hardware aspects that may all generally be referred to herein as a "circuit", "module" or "system". Furthermore, aspects of the controller may take the form of a computer program product embodied in one or more computer readable medium(s) having computer readable program code embodied thereon.

Any combination of one or more computer readable medium(s) may be utilized. The computer readable medium may be a computer readable storage medium. A computer readable storage medium may be, for example, but not limited to, an electronic, magnetic, optical, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electro-magnetic, optical, or any suitable combination thereof. A computer-readable signal medium may be any computer-readable medium that is not a computer-readable storage medium and that can communicate, propagate, or transport a program for use by or in connection with an instruction execution system, apparatus or device.

Program code embodied on a computer readable medium may be transmitted using an appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language, such as Java, Smalltalk, C++ or the like, and conventional procedural programming languages, such as the "C" programming language or similar programming languages.

Aspects of the present invention are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Although embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A system comprising:

an electronics rack comprising multiple electronic subsystems to be cooled and having an air inlet side and an air outlet side respectively enabling ingress and egress of air through the electronics rack;

a cooling apparatus associated with the electronics rack, the cooling apparatus comprising:

at least one liquid coolant loop, the at least one liquid, coolant loop comprising a liquid coolant transport pipe;

at least one liquid coolant pump coupled to circulate liquid coolant through at least one liquid coolant loop; and at least one heat exchanger associated with the electronics rack, and coupled in fluid communication with the liquid coolant loop, the at least one heat exchanger assisting in transferring heat generated by one or more electronic subsystems of the multiple electronic subsystems to the liquid coolant within the liquid coolant loop; and a liquid-coolant-driven electricity-generating system comprising:

a housing coupled in fluid communication with the liquid coolant transport pipe of the cooling apparatus associated with the one electronics rack, the housing comprising a first end and a second end, the first end receiving liquid coolant flowing through the liquid coolant transport pipe, and the second end returning the liquid coolant to the liquid coolant transport pipe;

a longitudinally-extending axial shaft positioned within the housing;

an impeller coupled to and extending radially from the longitudinally-extending axial shaft, the impeller and longitudinally-extending axial shaft being configured and positioned to turn with the flow of the liquid coolant there-across;

at least one magnetic structure distinct from the longitudinally extending axial shaft and distinct from the impeller, and fully embedded within at least one of the impeller or the longitudinally-extending axial shaft to turn with turning of the impeller and the longitudinally-extending axial shaft, wherein the at least one magnetic structure fully embedded within the impeller or the longitudinally-extending axial shaft does not change a fluid flow cross-section through the housing defined by the housing, and the longitudinally-extending axial shaft and the impeller positioned therein; and an electrical circuit, wherein electricity is generated for the electrical circuit with turning of the at least one magnetic structure, the electrical circuit supplying the electricity to an electrical load associated with the electronics rack.

2. The system of claim 1, wherein the housing of the liquid-coolant-driven, electricity-generating system is coupled in fluid communication within the liquid coolant transport pipe of the cooling apparatus, and the data center comprises an electronics rack and a heat exchanger facilitating cooling of air flowing through or egressing from the electronics rack, the fluid transport pipe being coupled in fluid communication with the heat exchanger and facilitating flow of the fluid through the heat exchanger.

3. The system of claim 2, wherein the heat exchanger is mounted to a door, the door being hingedly mounted along one edge to the electronics rack at one of the air inlet side or the air outlet side thereof.

4. The system of claim 3, further comprising:

an airflow director configured for the electronics rack, wherein the airflow director redirects airflow exhausting from the electronics rack at the air outlet side thereof via an airflow return pathway back towards the air inlet side of the electronics rack; and wherein the heat exchanger is disposed within the airflow return pathway for cooling redirected airflow exhausting from the air outlet side of the electronics rack before returning to the air inlet side thereof.

5. The system of claim 2, wherein the electrical circuit is a low voltage circuit and the electrical load comprises at least one of an electronic control or a sensor associated with the electronics rack.

6. The system of claim 1, wherein the housing, the longitudinally-extending axial shaft, the impeller and the at least one magnet structure of the liquid-coolant-driven, electricity-generating system are part of a field-replaceable unit, the field-replaceable unit being sized to attach to the liquid coolant transport pipe.

7. The system of claim 1, wherein the longitudinally-extending axial shaft is positioned substantially coaxial with the liquid coolant transport pipe and is maintained in axial position by a first mounting structure and a second mounting structure disposed within the housing at opposite ends of the longitudinally-extending axial shaft.

8. The system of claim 7, wherein the at least one magnetic structure is fully embedded within the impeller.

9. The system of claim 7, further comprising a wire-wound coil at least partially encircling the housing, wherein turning of the at least one magnetic structure produces an alternating magnetic field which extends outside the housing to the wire-wound coil, thereby generating electricity within the wire-wound coil, and wherein the wire-wound coil is part of the electrical circuit.

10. The system of claim 9, wherein the electrical circuit further comprises a voltage regulator and a rechargeable battery, wherein electricity generated within the wire-wound coil facilitates charging, via the voltage regulator, the rechargeable battery.

11. The system of claim 1, wherein the impeller is disposed within a central region of the housing, the central region of the housing having a larger diameter than a diameter of the first end and the second end of the housing to minimize pressure drop of the liquid coolant flowing through the liquid coolant transport pipe.

12. A system comprising:

multiple electronics racks, one electronics rack of the multiple electronics racks comprising multiple electronic subsystems to be cooled, and having an air inlet side and an air outlet side respectively enabling ingress and egress of air through the one electronics rack;

a cooling apparatus associated with the one electronics rack, the cooling apparatus comprising:

at least one liquid coolant loop, the at least one liquid coolant loop comprising a liquid coolant transport pipe;

at least one liquid coolant pump coupled to circulate liquid coolant through the at least one liquid coolant loop; and at least one heat exchanger associated with the electronics rack and coupled in fluid communication with the liquid coolant loop, the at least one heat exchanger assisting in transferring heat generated by one or more electronic subsystems of the multiple electronic subsystems to the liquid coolant within the liquid coolant loop; and a liquid-coolant-driven, electricity-generating system comprising:

a housing coupled in fluid communication with the liquid coolant transport pipe, the housing comprising a first end and a second end, the first end receiving liquid coolant flowing through the liquid coolant transport pipe, and the second end returning the liquid coolant to the fluid transport pipe;

a longitudinally-extending axial shaft positioned within the housing;

an impeller coupled to and extending radially from the longitudinally-extending axial shaft, the impeller and longitudinally-extending axial shaft being configured and positioned to turn with the flow of fluid thereacross;

at least one magnetic structure distinct from the longitudinally extending axial shaft and distinct from the impeller, and fully embedded within at least one of the impeller or the longitudinally-extending axial shaft to turn with turning of the impeller and the longitudinally-extending axial shaft, wherein the at least one magnetic structure fully embedded within the impeller or the longitudinally-extending axial shaft does not change a fluid flow cross-section through the housing defined by the housing, and the longitudinally-extending axial shaft and the impeller positioned therein; and an electrical circuit, wherein electricity is generated for the electrical circuit with turning of the at least one magnetic structure, the electrical circuit facilitating supplying the electricity to an electrical load associated with the one electronics rack.

13. The system of claim 12, wherein the heat exchanger is mounted to a door, the door being hingedly mounted along one edge to the one electronics rack at one of the air inlet side or the air outlet side thereof.

14. The system of claim 12, further comprising:

an airflow director configured for the one electronics rack, wherein the airflow director redirects airflow exhausting from the electronics rack at the air outlet side via an airflow return pathway back towards the air inlet side of the electronics rack; and wherein the heat exchanger is disposed within the airflow return pathway for cooling redirected airflow exhausting from the air outlet side of the electronics rack before returning to the air inlet side thereof.

15. The system of claim 12, wherein the longitudinally-extending axial shaft is positioned substantially coaxial with the liquid coolant transport pipe and is maintained in axial position by a first mounting structure and a second mounting structure disposed within the housing at opposite ends of the longitudinally-extending axial shaft.

16. The system of claim 15, wherein the liquid-coolant-driven, electricity-generating system further comprises a wire-wound coil at least partially encircling the housing, wherein turning of the at least one magnetic structure produces an alternating magnetic field which extends outside the housing to the wire-wound coil, thereby generating electricity within the wire-wound coil, and wherein the wire-wound coil is part of the electrical circuit.

17. The system of claim 1, wherein the at least one heat exchanger of the cooling apparatus comprises at least one air-to-coolant heat exchanger associated with the electronics rack and positioned for air passing through the electronics rack to pass across the at least one air-to-cooled heat exchanger to extract therefrom heat generated by the one or more electronic subsystems of the multiple subsystems of the electronics rack.

* * * * *